United States Patent [19]

Ujino et al.

[11] Patent Number: 4,799,079

[45] Date of Patent: Jan. 17, 1989

[54] ELECTROSTATIC COPYING APPARATUS CAPABLE OF COPYING ON BOTH SURFACES

[75] Inventors: Koji Ujino, Osaka; Tadashi Fujioka, Toyonaka, both of Japan

[73] Assignee: Mita Industrial Co., Ltd., Osaka, Japan

[21] Appl. No.: 49,818

[22] Filed: May 14, 1987

[30] Foreign Application Priority Data

May 17, 1986 [JP] Japan ..... 61-111815
Nov. 21, 1986 [JP] Japan ..... 61-276499

[51] Int. Cl.[4] ..... G03G 15/00

[52] U.S. Cl. ..... 355/14 SH; 355/3 SH; 271/3.1

[58] Field of Search ..... 355/14 SH, 3 SH, 3 R, 355/14 R, 23, 24, 25, 26; 271/3.1, 4, 65

[56] References Cited

U.S. PATENT DOCUMENTS

| | | | |
|---|---|---|---|
| 4,413,901 | 11/1983 | Kollar | 355/3 SH |
| 4,462,681 | 7/1984 | Aerts et al. | 355/24 X |
| 4,466,733 | 8/1984 | Pels | 355/14 R |
| 4,561,765 | 12/1985 | Masuda | 355/14 SH |
| 4,561,772 | 12/1985 | Smith | 355/24 X |
| 4,674,866 | 6/1987 | Tanaka | 355/23 |
| 4,708,462 | 11/1987 | Stemmle | 355/24 |

*Primary Examiner*—A. C. Prescott
*Attorney, Agent, or Firm*—Wenderoth, Lind & Ponack

[57] ABSTRACT

An electrostatic copying apparatus capable of both-surface copying includes a main copying system and a document sending device for conveying a document to be copied through an exposure area. The main copying system includes a copying paper conveying device defining a copying paper conveying passage, an image forming device for forming an image on copying paper conveyed through the paper conveying passage, a copying paper returning device defining a copying paper returning passage for returning copying paper having the image formed on one surface and a paper re-feed device for receiving the copying paper returned through the paper returning passage and feeding it again to the paper conveying passage. According to a first aspect, improvement is made in the paper re-feed device, and according to a second aspect, a document feed device in the document sending device is improved. There is also provided a sheet material feeding device which can be conveniently applied to the paper re-feed device or the document feed device. The sheet material feeding device includes a first feed device for feeding sheet materials in the stacked state from the uppermost one and a second feed device for feeding the sheet materials from the lowermost one.

15 Claims, 16 Drawing Sheets

FIG. 3-A
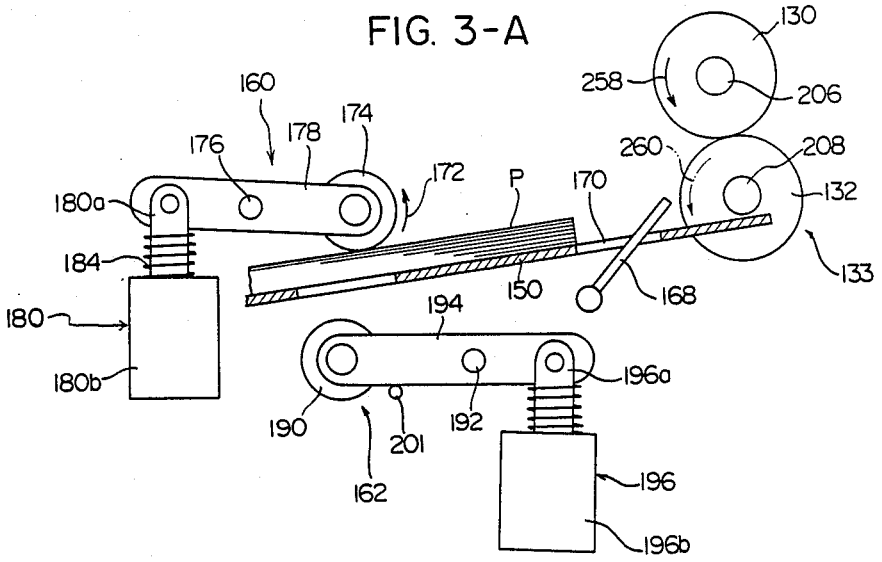
FIG. 3-B
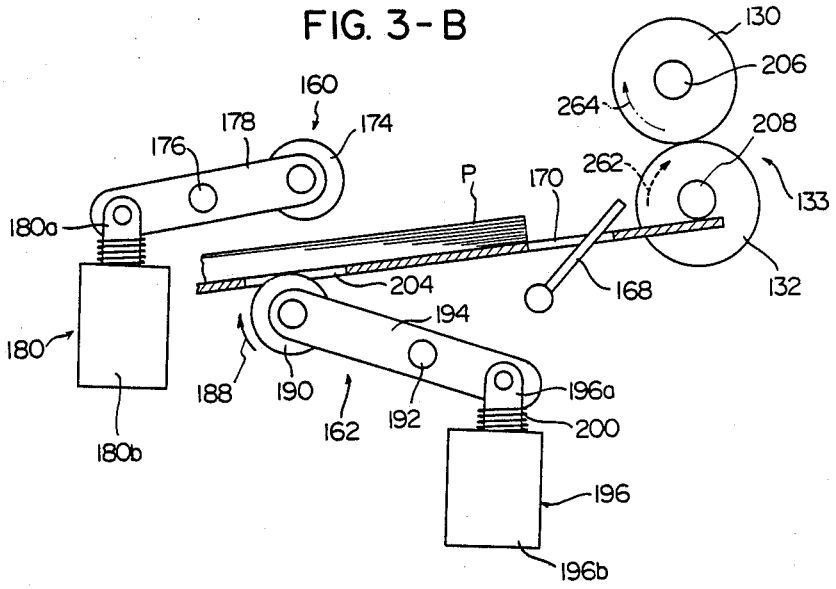

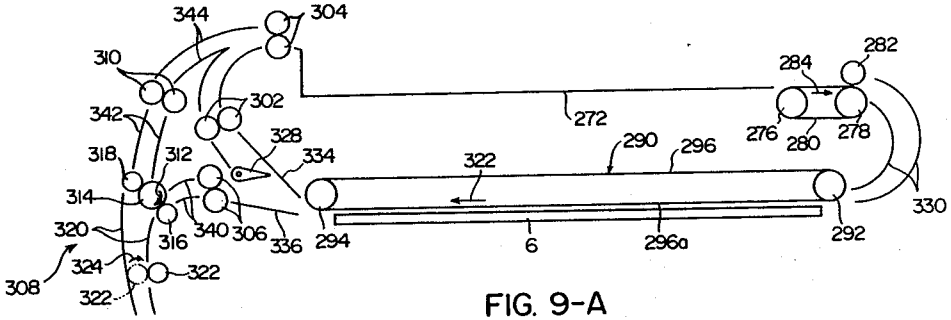
FIG. 9-A
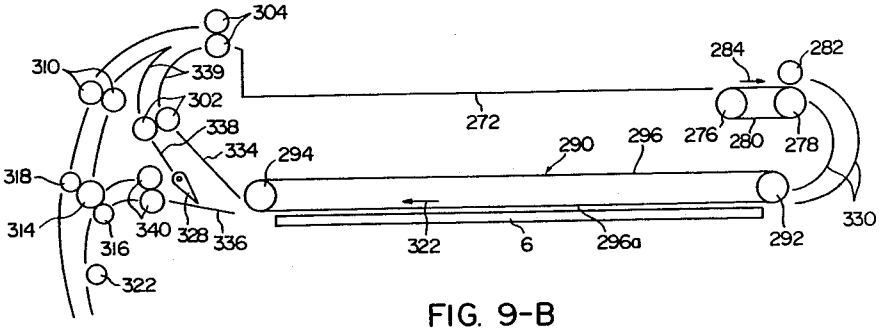
FIG. 9-B

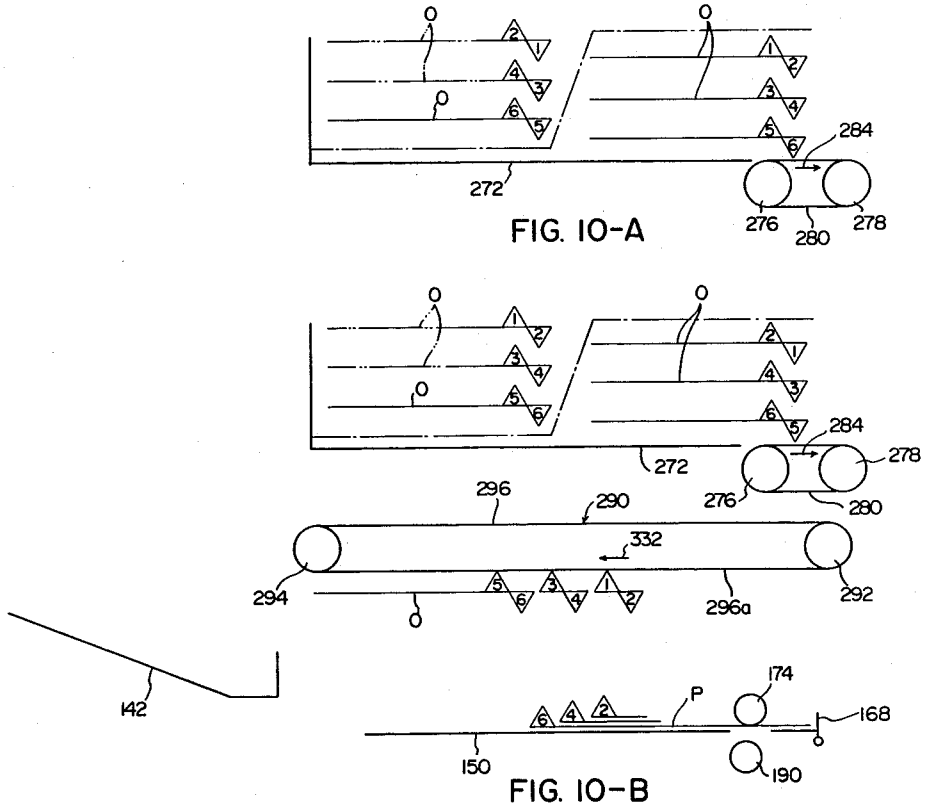
FIG. 10-A
FIG. 10-B

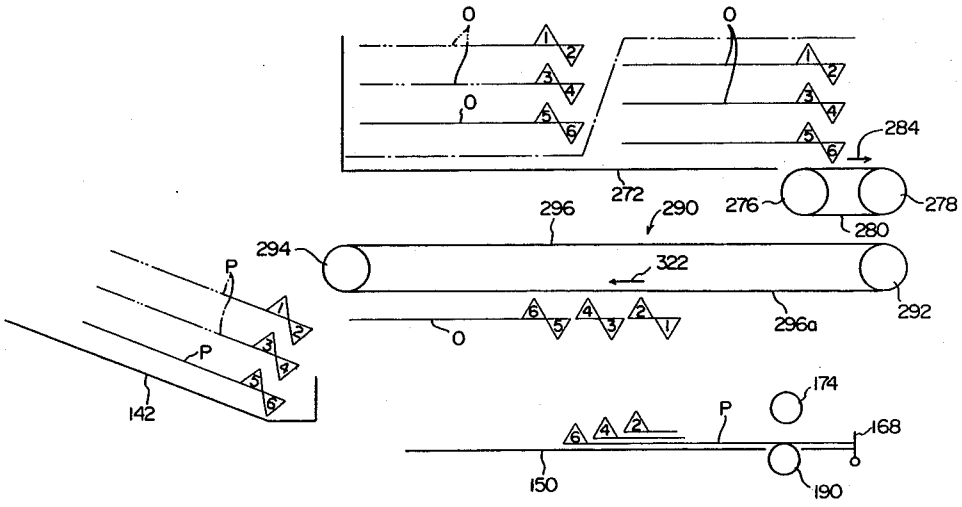
FIG. 10-C

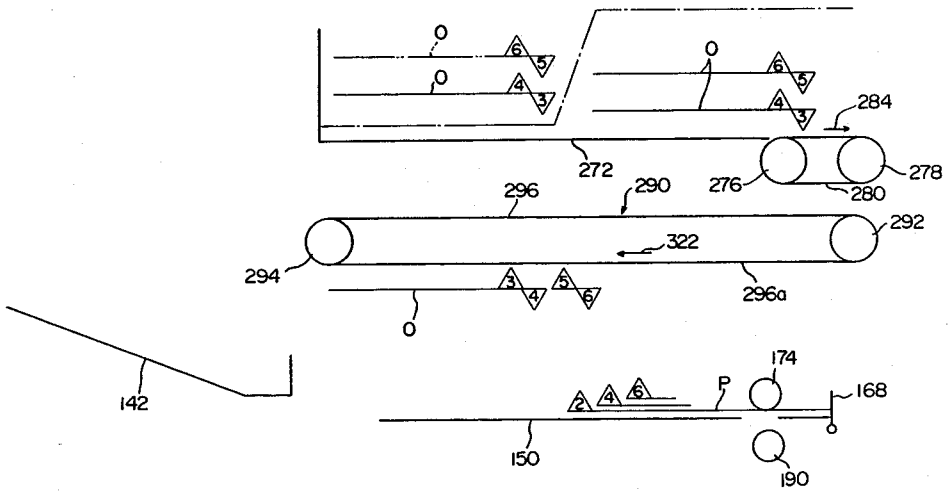
FIG. 11-A

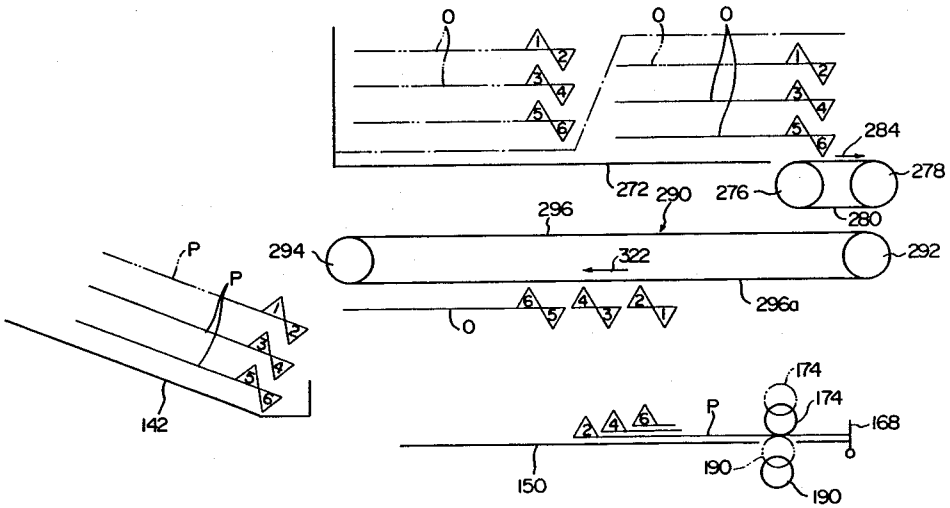
FIG. 11-B

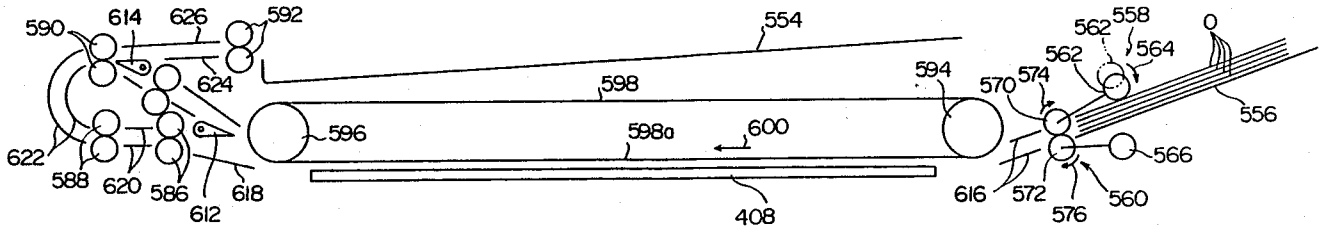
FIG. 15
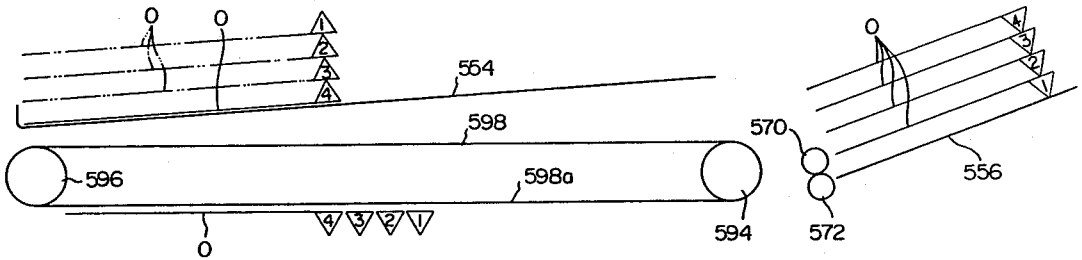
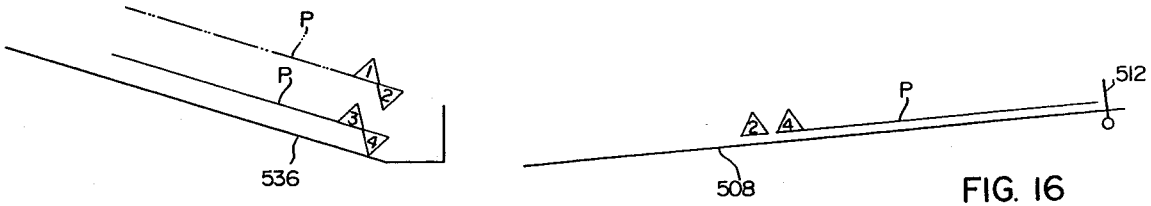
FIG. 16

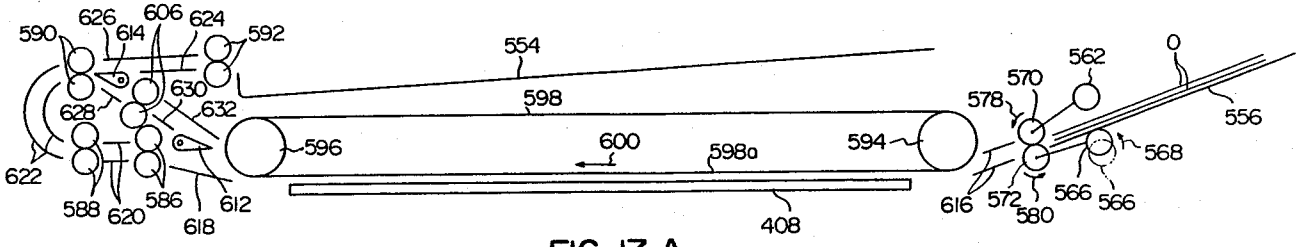
FIG. 17-A
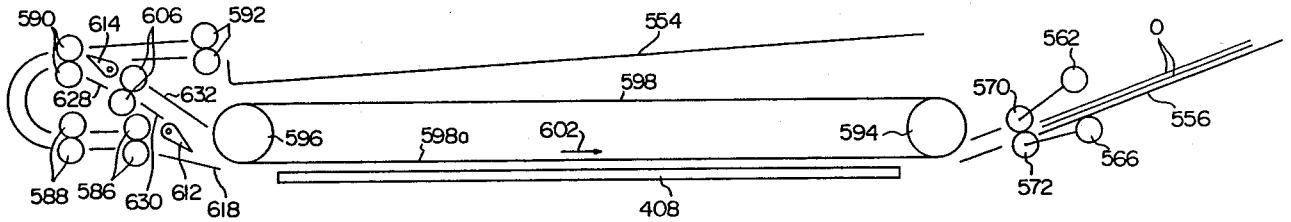
FIG. 17-B
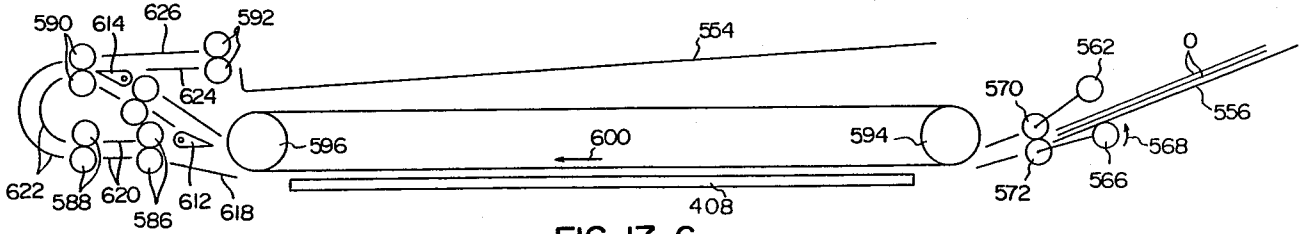
FIG. 17-C

ELECTROSTATIC COPYING APPARATUS CAPABLE OF COPYING ON BOTH SURFACES

FIELD OF THE INVENTION

This invention relates to an electrostatic copying apparatus capable of copying on both surfaces of copying paper.

DESCRIPTION OF THE PRIOR ART

In recent years, an electrostatic copying apparatus capable of copying documents on both surfaces of copying paers has been proposed and come into practical application in order to save copying paper and to decrease the number of documents to be preserved. Such type of electrostatic apparatus generally comprises copying paper conveying means defining a paper conveying passage, image-forming means for forming an image on copying paper conveyed through the paper conveying passage, copying paper returning means defining a paper returning passage for returning copying paper having an image formed on its one surface, and copying paper refeed means for receiving the copying paper returned through an paper returning passage and re-feeding it to the paper conveying passage.

On the other hand, an electrostatic copying apparatus equipped further with a device for sending documents to be copied through an exposure zone has also been widely used in order to simplify the copying operation. The document sending device is comprised of a document receiving stand, document feed means for feeding documents on the document receiving stand, and document conveying means for conveying the documents through the exposure zone.

The conventional electrostatic copying apparatus capable of forming a copied image on both surfaces of copying paper which is provided with the document sending device has some problems which are desired to be solved. Primary problems exist with regard to the mode of conveying the document in the document sending device and to the mode of conveying the copying paper in a main copying system in the copying apparatus. In particular, when both surfaces of a document are to be copied on both surfaces of copying paper, it is necessary to arrange the copied documents or the copies in proper sequence after the end of the both-surface copying, and this sequencing operation is troublesome. Furthermore, when both surfaces of a document are to be copied on both surfaces of copying paper, the operation of placing documents to be copied on the document receiving stand is relatively troublesome. Moreover, in the event of paper jamming, particularly when both surfaces of a document are to be copied on both surfaces of copying paper, comparatively many copying papers will be wasted, and the documents or the copies must be sequenced after the copying operation.

SUMMARY OF THE INVENTION

It is a main object of this invention to provide an improved electrostatic copying apparatus capable of copying on both surfaces in which, even in the case of copying on both surfaces, the documents and the copies are properly sequenced at the end of copying and no operation of sequencing is necessary.

It is another object of this invention to provide an improved electrostatic copying apparatus capable of copying on both surfaces in which, even in the case of both surface copying, the operation of placing documents is simple.

Still another object of this invention is to provide an improved electrostatic copying apparatus capable of copying on both surfaces in which wasting of copying papers in the event of paper jamming is reduced, and the documents and copies can be easily and simply sequenced.

Yet another object of this invention is to provide a sheet material feeding device which can be conveniently applied to an electrostatic copying apparatus capable of copying on both surfaces of copying paper.

Other objects of the invention along with its features will become apparent from the following description.

BRIEF DESCRIPTION OF THE DRAWINGS

FIGS. 3-A and 3-B are sectional views showing the paper re-feed means in a first feed condition and a second feed condition, respectively;

FIGS. 9-A and 9-B are simplified views illustrating the conveyance of a document when both surfaces of the document are to be copied on both surfaces of copying paper using the electrostatic copying apparatus shown in FIG. 1;

FIGS. 10-A to 10-C are simplified views illustrating the relationship among documents placed on the document receiving stand, copying papers received in the paper refeeding means, documents discharged to the document discharge section and copying papers discharged onto the receiving tray in the case shown in FIGS. 9-A and 9-B;

FIGS. 11-A and 11-B are simplified views illustrating the relationship among documents placed on the document receiving stand, new copying papers received in the paper re-feed means, documents discharged to the document discharge section, and copying papers discharged onto the receiving tray when paper jamming occurs during copying in FIGS. 9-A and 9-B;

FIG. 15 is a simplified view illustrating the conveyance of a document when one surface of the document is to be copied on both surfaces of copying paper using the electrostatic copying apparatus shown in FIG. 12;

FIG. 16 is a simplified view illustrating the relationship among documents placed on the document receiving stand, copying papers received in the paper re-feed means, documents discharged onto the document discharge section, documents discharged onto the document discharge section, and copying papers discharged onto the receiving tray in the case shown in FIG. 15;

FIGS. 17-A to 17-C are simplified views illustrating the conveyance of a document when both surfaces of the document are to be copied on both surfaces of copying paper using the electrostatic copying apparatus shown in FIG. 12.

DETAILED DESCRIPTION OF PREFERRED EMBODIMENTS

The invention will be described in detail with reference to the accompanying drawings.

First Embodiment of the Electrostatic Copying Apparatus

Figure 1:
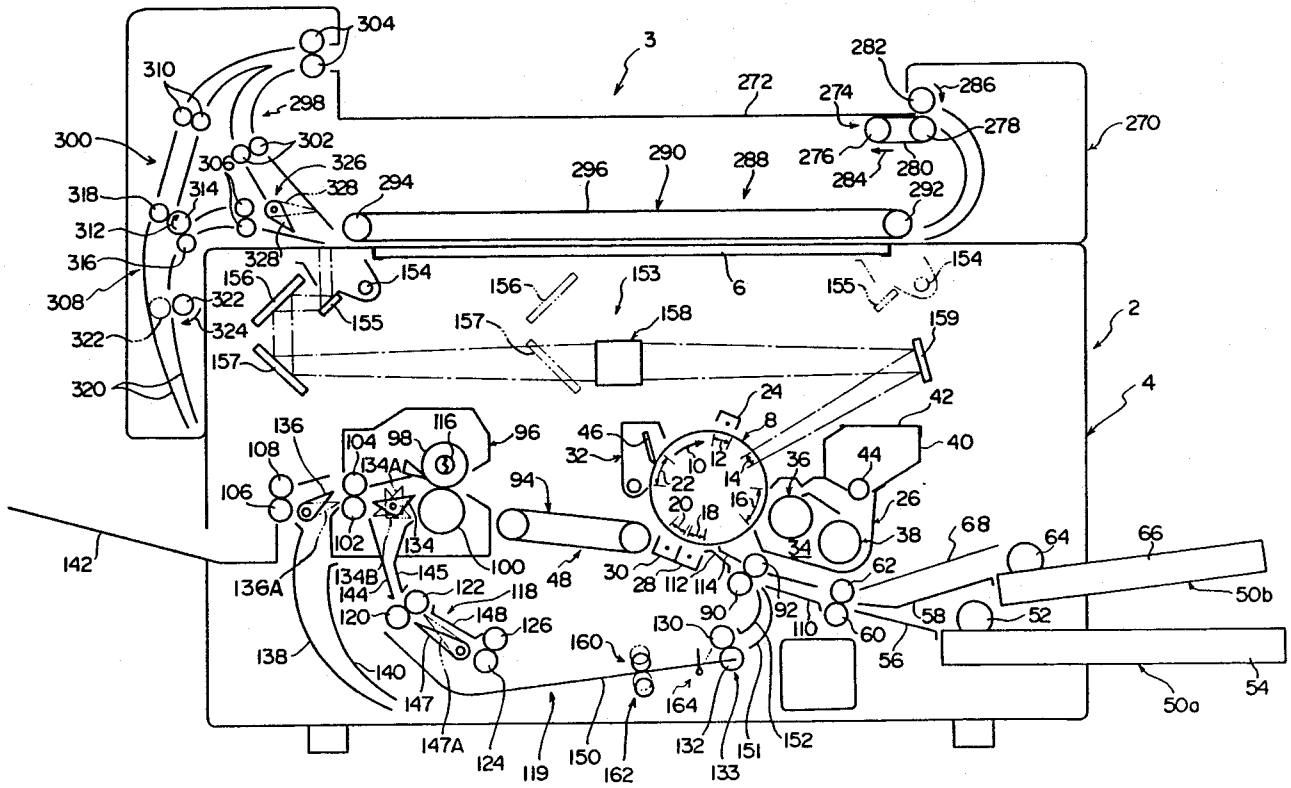
FIG. 1 is a sectional view showing in a simplified form a first embodiment of the electrostatic copying apparatus capable of copying on both surfaces of copying paper constructed in accordance with this invention.

FIG. 1 shows in a simplified form a first embodiment of the electrostatic copying apparatus in accordance with this invention. In FIG. 1, the illustrated electrostatic copying apparatus includes a main copying system 2 and a document sending device shown generally at 3 and disposed on the upper surface of the main copying system 2.

Outline of the Main Copying System of the Copying Apparatus in the First Embodiment With reference to FIG. 1, the main copying system 2 in the first embodiment has a parallelepipedal housing 4. A transparent plate 6 on which to place a document to be copied is disposed on the upper surface of the housing 4.

A rotating drum 8 constituting image-bearing means is disposed rotatably in the nearly central part of the housing 4. A photosensitive material is disposed on at least a part of the peripheral surface (on the entire peripheral surface in the illustrated embodiment) of the rotating drum 8. Around the rotating drum 8 to be rotated in the direction shown by an arrow 10 are disposed a charging zone 12, an exposure zone 14, a developing zone 16, a transfer zone 18, a peeling zone 20 and a cleaning zone 22 in this sequence as viewed in the rotating direction of the rotating drum 8. A charging corona discharge device 24 is provided in the charging zone 12. A developing device 26 is provided in the developing zone 16. A transfer corona discharge device 28 is provided in the transfer zone 18, and a peeling corona discharge device 30, in the peeling zone 20. A cleaning device 32 is provided in the cleaning zone 22. The illustrated developing device 26 is equipped with a development receptacle 34 for holding a developer composed of toner particles and carrier particles. A magnetic brush mechanism 36 is disposed at that site within the development receptacle 34 which is opposite to the rotating drum 8. An agitating mechanism 38 for agitating the developer is also disposed within the development receptacle 34. An opening is formed in the upper surface of the development receptacle 34 and a toner particle holding vessel 40 is mounted on the opening portion. The toner particle holding vessel 40 is opened at its upper surface and a closure 42 is mounted on the opening portion of the upper surface for free opening and closing. A discharge opening is formed in the bottom wall of the toner particle holding vessel 40, and a toner particle feed roller 44 is rotatably mounted on the discharge opening. Hence, fresh toner particles are supplied to the toner particle holding vessel 40 by opening the closure 42. The toner particles held in the vessel 40 are fed to the development receptacle 34 through the discharge opening by the rotation of the toner particle feed roller 44. The developer in the development receptacle 34 is held by the magnetic brush mechanism 36 and is brought into contact with the peripheral surface of the rotating drum 8 in the developing zone 16. The illustrated cleaning device has a cleaning blade 46 acting on the surface of the photosensitive material on the rotating drum 8.

Copying paper conveying means shown generally at 48 is also disposed within the housing 4. Copying paper feed means is provided at one end portion (the right end portion in FIG. 1) of the paper conveying means 48. In the illustrated embodiment, the paper feed means is comprised of a first copying paper feed device 50*a* and a second copying paper feed device 50*b* of the cassette type. The first paper feed device 50*a* is constructed of a cassette receiving section with a feed roller 52 and a copying paper cassette 54 to be detachably loaded into the cassette receiving section through an opening formed in the right wall of the housing 4. By the action of the feed roller 52, copying paper sheets are fed one by one from a stack of paper sheets (not shown) held in the cassette 54. The copying paper fed from the cassette 54 is sent to a pair of conveyor rollers 60 and 62 after advancing between guide plates 56 and 58.

The second paper feed device 50*b* disposed above the first paper feed device 50*a* is comprised of a combination of a cassette receiving section with a feed roller 64 and a copying paper cassette 66 to be detachably loaded into the cassette receiving section through the opening formed in the right wall of the housing 4. By the action of the feed roller 64, paper sheets are fed one by one from a stack of paper sheet (not shown) held in the cassette 66. The copying paper fed from the cassette 66 is sent to the pair of conveyor rollers 60 and 62 through the space between the guide plate 58 and a guide plate 68. In the illustrated embodiments, copying paper sheets having a JIS A3 size, for example, are held in the paper cassette 54, and copying paper sheets of a JIS A4 size, for example, in the paper cassette 66.

The illustrated copying paper conveying means 48 includes the pair of conveyor rollers 60 and 62, a pair of conveyor rollers 90 and 92, a conveyor belt mechanism 94, an upper roller 98 and a lower roller 100 in a fixing device 96, a pair of switching conveyor rollers 102 and 104, and a pair of discharge rollers 106 and 108. These elements define a paper conveying passage extending in a direction from right to left in FIG. 1. Hence, the copying paper fed to the conveyor rollers 60 and 62 from the paper feed means (the first paper feed device 50*a* or the second paper feed device 50*b*) is conveyed to the pair of conveyor rollers 90 and 93 past the guide plate 110 by the action of the pair of conveyor rollers 60 and 62. Between the guide plates 112 and 114, it is conveyed to the transfer zone 18 and the peeling zone 20 by the action of the pair of conveyor rollers 90 and 92. Then, the copying paper is conveyed by the action of the conveyor belt mechanism 94 and fed to the upper roller 98 having a heater 116 disposed therein and the lower roller 100 kept in press contact with the upper roller 98.

It will be seen from FIG. 1 that the illustrated electrostatic copying apparatus permits both-surface copying and one-surface overlapping copying. In relation to this, therefore, the apparatus includes copying paper returning means 118 defining a copying paper returning passage, and downstream of the paper returning means 118 is disposed of copying paper re-feed means 119 (to be described in detail hereinafter) to which a sheet material feed device in accordance with this invention is applied. The illustrated paper returning means 118 is provided with a pair of conveyor rollers 120 and 122 and a pair of conveyor rollers 124 and 126, and further includes a first conveying direction switching means disposed between the upper roller 98 and the lower roller 100 and the pair of switching conveyor rollers 102 and 104, a second conveying direction switching means disposed between the pair of switching conveying rollers 102 and 104 and the pair of discharge rollers 106 and 108, and a holding section for switching the conveying direction disposed below the second conveying direction switching means. The first conveying direction switching means is equipped with a switching guide member 134 which is adapted to be selectively held at a first position shown by solid lines in FIG. 1, a second position shown by two-dot chain lines 134A and a third position shown by two-dot chain lines 134B. The switching guide member 134 is held at the first position when it conducts the copying paper toward the pair of switching conveyor rollers 102 and 104 from the upper roller 98 and the lower roller 100; at the second position when it conducts the copying paper toward the conveyor rollers 120 and 122 from the upper roller 98 and the lower roller 100; and at the third position when it conducts the copying paper toward the pair of conveyor rollers 120 and 122 from the conveying direction switching holding section by the action of the pair of switching conveyor rollers 102 and 104. The second conveying direction switching means is provided with a switching guide member 136 adapted to be selectively held at a first position shown by two-dot chain lines 136A in FIG. 1 and a second position shown by solid lines. The switching guide member 136 is held at the first position when it conducts the copying paper toward the pair of discharge rollers 106 and 108 from the pair of switching conveying rollers 102 and 104, and at the second position when it conducts the copying paper to the conveying direction switching holding section from the upper roller 98 and the lower roller 100 by the action of the pair of switching conveyor rollers 102 and 104, or it conducts the copying paper toward the pair of conveyor rollers 120 and 122 from the switching holding section by the action of the pair of switching conveying rollers 102 and 104. The aforesaid positioning of the switching guide members 134 and 136 is achieved by an actuator such as a rotary solenoid.

The conveying direction switching holding section is comprised of a pair of spaced guide holding plates 138 and 140, and in relation to the foregoing description, the switching conveyor rollers 102 and 104 can be rotated in a normal and a reverse direction. An oscillating guide member 147 free to oscillate between a first position shown by solid lines and a second position shown by two-dot chain line lines 147A is disposed between the pair of conveyor rollers 120 and 122 and the pair of conveyor rollers 124 and 126. The oscillating guide member 147 is held at the first position when the size of copying paper is relatively small, and at the second position when the paper size is relatively large.

The paper re-feed means 119 is provided with a copying paper receiving stand 150. The paper receiving stand 150 extends from left to right in FIG. 1 below the paper conveying passage, and at its front end position is provided an overlapping feed preventing means 133 comprised of a pair of a first upper roller 130 and a second lower roller 132.

A copying paper re-feed passage for conducting the copying paper fed from the paper re-feed means 119 in the manner to be described hereinafter toward the paper conveying passage is disposed downstream of the paper re-feed means 119. In the illustrated embodiment, the paper re-feed passage is defined by a pair of guide plates 151 and 152.

On the other hand, in the upper portion of the housing 4, an optical device shown generally at 153 is provided for scanning and exposing a document on the transparent plate 6 and projecting the image of the document onto a photosensitive material on the rotating drum 8 in the exposure zone 14. The optical device 153 has a document illuminating lamp 154 for illuminating the document placed on the transparent plate 6, and a first reflecting mirror 155, a second reflecting mirror 156, a third reflecting mirror 157, a lens assembly 158 and a fourth reflecting mirror 159 for projecting the reflected light from the document onto the photosensitive material. During scanning exposure, the document illuminating lamp 154 and the first reflecting mirror 155 are moved at a velocity V from a start-of-scan position shown by solid lines to a given position (for example, a maximum end-of-scan position shown by two-dot chain lines) substantially horizontally, and the second reflecting mirror 156 and the third reflecting mirror 157, at a velocity ($\frac{1}{2}$ V) half of the moving velocity V from start-of-scan position shown by a solid lines to a given position (for example, a maximum end-of-scan position shown by two-dot chain lines). At this time, the reflected light from the document illuminated by the document illuminating lamp 154 is reflected successively by the first, second and third reflecting mirrors 155, 156 and 157 and reaches the lens assembly 158. It is then reflected by the fourth reflecting mirror 159, and reaches the photosensitive material in the exposure zone 14. When the scanning exposure is over, the document illuminating lamp 154, the first reflecting mirror 155, the second reflecting mirror 156 and the third reflecting mirror 157 are returned to the start-of-scan position shown by solid lines.

The operation of the main body of the copying apparatus described above and shown in the drawings will be generally described below.

The rotating drum 8 is rotated in the direction of arrow 10. During the rotation of the rotating drum 8, the charging corona discharge device 24 substantially uniformly charges the photosensitive material to a specific polarity in the charging zone 12. Then, in the exposure zone 14, the optical device 153 projects the image of the document to form a latent electrostatic image corresponding to the document on the photosensitive material. Thereafter in the developing zone 16, the developing device 26 applies a toner to the electrostatic latent image on the photosensitive material to develop the latent electrostatic image to a toner image. In the transfer zone 18, the copying paper fed from the paper feed means as described above (the conveying of the paper will be further described hereinafter) is brought into contact with the photosensitive material, and by the action of the transferring corona discharge device 28, the toner image on the photosensitive material is transferred to the copying paper. Then, in the peeling zone 20, the copying paper is peeled from the photosensitive material by the action of the peeling corona discharge device 30. After peeling, the rotating drum 8 continues to rotate, and in the cleaning zone 22, the toner particles remaining on the photosensitive material after transfer are removed by the action of the cleaning blade 46 of the cleaning device 32. In the meantime, the copying paper having the toner image transferred thereto is conveyed to the fixing device 96 where the toner image is fixed under heat.

Now, the conveying of copying paper will be described.

In the case of forming an image only on one surface of copying paper, the switching guide members 134 and 136 are held at the first positions. The copying paper introduced into the paper conveying passage from the paper feed means (the first paper feed device 50*a* or the second paper feed device 50*b*) is conveyed through the paper conveying passage, and during this time, the toner image is transferred to one surface (the upper surface) of the copying paper. The toner image is fixed to one surface of the paper by the action of the upper roller 98 and the lower roller 100 of the fixing device 96. Then, the paper having an image formed on one surface thereof is fed to the pair of switching conveyor rollers 102 and 104 after passing over the upper surface of the switching guide member 134 held at the first position. It is then conveyed to the pair of discharge rollers 106 and 108 after passing over the switching guide member 136 by the action of the pair of switching conveyor rollers 102 and 104 which are rotating in a normal direction (the direction in which the paper is conveyed downstream), and discharged onto the receiving tray 142 through an opening formed in the left wall of the housing 4 by the action of the pair of discharge rollers 106 and 108. As a result, a copy having the image formed on its one surface is obtained.

In the case of forming an image overlappingly on one surface of the copying paper, the switching guide member 134 is held at the second position and the switching guide member 136, at the first position. The copying paper introduced into the paper conveying passage from the paper feed means is conveyed through the paper conveying passage. During this conveyance, an image is formed on one surface of the paper in the manner described hereinabove. The copying paper having the image formed on one surface is then guided by the right side edge of the switching guide member 134 held at the second position, introduced into the paper returning passage, and through the paper returning passage, received properly by the paper receiving stand 150 of the paper re-feed means 119. When the copying paper conveyed at this time is of a relatively small size, the paper fed to the pair of conveyor rollers 120 and 122 is conveyed to the pair of conveyor rollers 124 and 126 via a space between the guide plate 148 and the oscillating guide member 147, held at the first position thereof, by the action of the pair of conveyor rollers 120 and 122, and further by the action of the conveyor rollers 124 and 126, is received in the paper re-feed means 119. On the other hand, if the copying paper is of a relatively large size, the paper fed to the pair of conveyor rollers 120 and 122 is guided to the under surface of the oscillating guide member 147, held at the second position thereof, by the action of the pair of conveyor rollers 120 and 122 and directly received by the paper re-feed means 119. When a required number of copying paper sheets have been received in the paper re-feed means 119, the switching guide member 134 is moved to the first position. Thereafter, the copying papers are delivered to the paper re-feed passage from the paper re-feed means 119 in the manner to be described hereinafter. The delivered copying paper sheets are fed to the paper conveying passage one by one via the paper re-feed passage. During re-conveying through the paper conveying passage, a toner image is transferred overlappingly on the aforesaid one surface of the copying paper in the transfer zone 18. By the action of the fixing device 96, the toner image is fixed to the paper to form the image overlappingly on one surface of the paper. The copying paper is then guided by the upper surfaces of the switching guide members 134 and 136 at the first positions, and discharged onto the receiving tray 142 in the same way as in the case of one-surface copying. As a result, a copy having images overlappingly on one surface thereof is obtained.

In the case of forming an image on both surfaces of copying paper, the switching guide member 134 is held at the first position and the switching guide member 136 is held at the second position. The copying paper introduced into the paper conveying passage from the paper feed means is conveyed through the paper conveying passage, and during this conveyance, an image is formed on one surface of the paper in the same way as described above. The copying paper having the image formed on its one surface is then fed to the pair of switching conveyor rollers 102 and 104 via the upper surface of the switching guide member 134 held at the first position, and by the action of the switching conveyor rollers 102 and 104 rotating in the normal direction, is guided by the lower undersurface of the switching guide member 136 held at the second position and introduced into between the guide holding plates 138 and 140. When the trailing end of the copying paper conveyed as described above goes past the switching guide member 134 (at which time the trailing end portion of the copying paper is nipped between the pair of switching conveyor rollers 102 and 104), the switching guide member 134 is held at the third position and the switching conveyor rollers 102 and 104 are rotated in an opposite direction (the direction in which the paper is conveyed upstream). The copying paper conducted between the guide holding plates 138 and 140 is guided to the left side edge of the switching guide member 134 from its rear end side by the action of the switching conveyor rollers 102 and 104 rotating in the opposite direction, and introduced into the paper returning passage. Through the paper returning passage, it is received properly in the paper receiving stand 150 of the paper re-feed means 119. As in the case of one surface overlapping copying, if the size of the paper is relatively small, the paper fed to the pair of conveyor rollers 120 and 122 advances between the oscillating guide member 147 and the guide plate 148 and by the action of the pair of conveyor rollers 124 and 126, is received by the paper re-feed means 119. On the other hand, when the paper size is relatively large, the copying paper fed to the conveyor rollers 120 and 122 is guided by the under surface of the oscillating guide member 147 and received directly by the paper re-feed means 119. When a required number of copying paper sheets have been received by the paper re-feed means 119 as described above, the switching guide members 134 and 136 are moved to the first positions. Thereafter, the copying paper sheets are delivered to the paper re-feed passage from the paper re-feed means 119 in the manner to be described. The delivered copying papers are fed one by one to the paper conveying passage via the paper re-feed passage, and during re-conveying through the paper conveying passage, a toner image is transferred to the other surface of the copying paper (that surface which is opposite to the image-bearing surface) in the transfer zone 18. The toner image is then fixed to the other surface of the copying paper by the action of the fixing device 96. Thus, images are formed on both surfaces of the copying paper. Then, as in the case of one-surface copying, the copying paper is guided by the upper surfaces of the switching guide members 134 and 136 held at the first positions, and discharged onto the receiving tray 142. As a result, a copy having images formed on both surfaces is obtained.

Copying paper re-feed means in the first embodiment

Now, with reference to FIGS. 1 and 2, the copying paper re-feed means 119 will be described. The illustrated copying paper re-feed means 119 includes the paper receiving stand 150, the overlapping feed preventing means 133, a first feed means 160 disposed above the paper receiving stand 150, and a second feed means 162 disposed below the paper receiving stand 150. The paper receiving stand 150 is constructed of a plate-like member, and permits receipt of copying papers returned through the paper returning passage, in a stacked state on its surface. Stop means 164 is annexed to the front end portion of the paper receiving stand 150. The illustrated stop means 164 is comprised of a hampering piece 168 secured to a supporting shaft 166 mounted rotatably. The hampering piece 168 is selectively held at an operative position, shown by solid lines in FIG. 1 and also in FIG. 2, and a non-operative position shown by a two-dot chain line in FIG. 1 and by solid lines in FIGS. 3-A and 3-B, by an actuator (not shown) such as an electromagnetic solenoid. At the operative position, the hampering piece 168 projects upwardly substantially perpendicularly from the upper surface of the paper receiving stand 150 (an opening 170 is formed in the paper receiving stand 150 so that the hampering piece 168 can project upwardly), and makes contact with the leading end of the copying paper moving over the paper receiving stand 150 to hamper the movement of the copying paper accurately. On the other hand, at the non-operative position, the hampering piece 168 is inclined in the paper feeding direction toward the nipping position of the first roller 130 and the second roller 132, and permits feeding of the paper in the manner to be described and conducts it toward the nipping site of the rollers 130 and 132.

Figure 2:
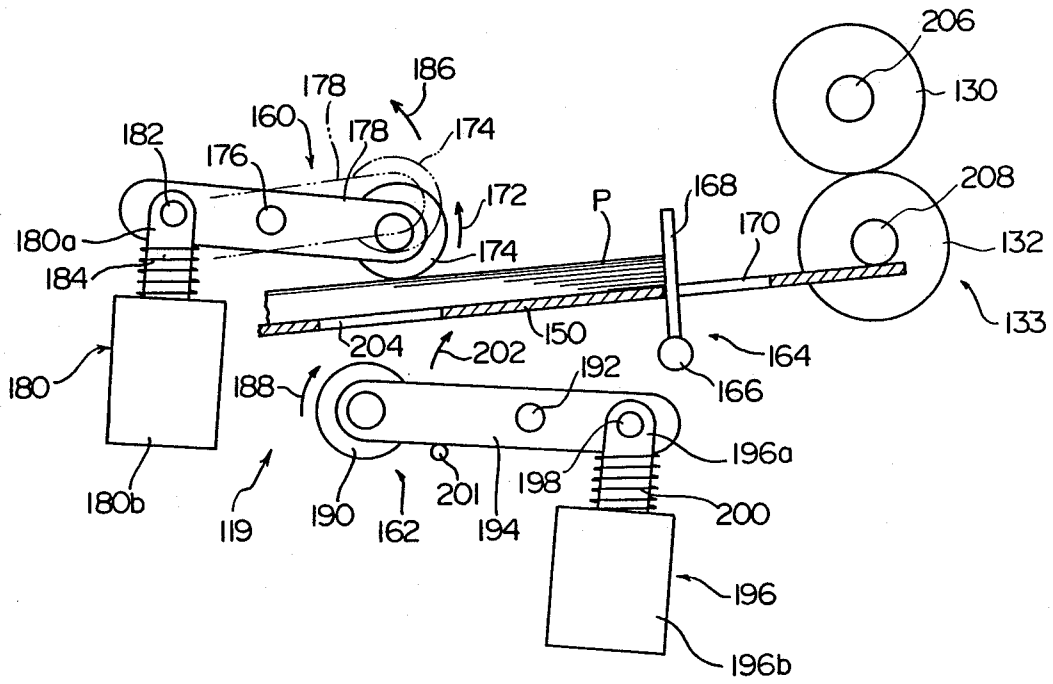
FIG. 2 is a sectional view showing part of paper re-feed means in the electrostatic copying apparatus of FIG. 1 on an enlarged scale.

The first feed means 160 is provided with a first feed roller 174 to be rotated in the direction shown by an arrow 172 (FIGS. 2 and 3-A). The first feed roller 174 is adapted to be selectively held in an operative state shown by solid lines in FIG. 2 and also in FIG. 3-A and a non-operative state shown by two-dot chain lines in FIG. 2 and by solid lines in FIG. 3-B. In more detail, an oscillating arm 178 is oscillably mounted via a pin member 176, and the first feed roller 174 is mounted rotatably on one end portion of the oscillating arm 178. An output portion **180*a* of an electromagnetic solenoid 180 is pivotably linked to the other end portion of the oscillating arm 178 via a pin member 182. A coil spring 184 is disposed between the other end portion of the oscillating arm 178 and a main body portion 180*b* of the electromagnetic solenoid 180 in a manner to surround the output portion 180*a*. When the electromagnetic solenoid 180 is in the deenergized state, the feed roller 174 makes contact with the paper receiving stand 150 (more specifically, the copying paper on the receiving stand 150) mainly by its own weight and acts on the upper surface of the paper receiving stand (namely, the feed roller 174 is at the aforesaid operative state). When the electromagnetic solenoid 180 is energized, the oscillating arm 178 is pivoted in the direction shown by an arrow 186 against the biasing force of the coil spring 184 to move the feed roller 174 upwardly away from the paper receiving stand (the paper on the paper receiving stand 150) (namely, the feed roller 174** is held at the aforesaid non-operative state).

The illustrated second feed means 162 has a second feed roller 190 to be rotated in the direction shown by an arrow 188 (FIGS. 2 and 3-B). The second feed roller 190 is adapted to be selectively held in a non-operative state shown in FIGS. 2 and 3-A and an operative state shown in FIG. 3-B. Specifically, substantially like the first feed means 162, an oscillating arm 194 is oscillably mounted via a pin member 192, and the second feed roller 190 is pivotably mounted on one end portion of the oscillating arm 194. An output portion **196*a* of an electromagnetic solenoid 196 is pivotably linked to the other end portion of the oscillating arm 194 via a pin member 198. A coil spring 200 is disposed between the other end portion of the oscillating arm 194 and a main body portion 196*a* of the electromagnetic solenoid 196 in a manner to surround the output portion 196*a*. Thus, when the electromagnetic solenoid 196 is in the deenergized state, the second feed roller 190 moves away downwardly from the paper receiving stand 150 mainly by its own weight and is held in the aforesaid non-operative state (by the contacting of the oscillating arm 194 with a fixed pin 201). When the electromagnetic solenoid 196 is energized, the oscillating arm 194 is pivoted in the direction shown by an arrow 202 against the biasing force of the coil spring 200 to cause the second feed roller 190 to contact the lowermost paper sheet on the paper receiving stand 150 through an opening 204 formed in the paper receiving stand 150, and the feed roller 190** is held in the operative state in which it acts on the lower surface of the lowermost paper.

Figure 4:
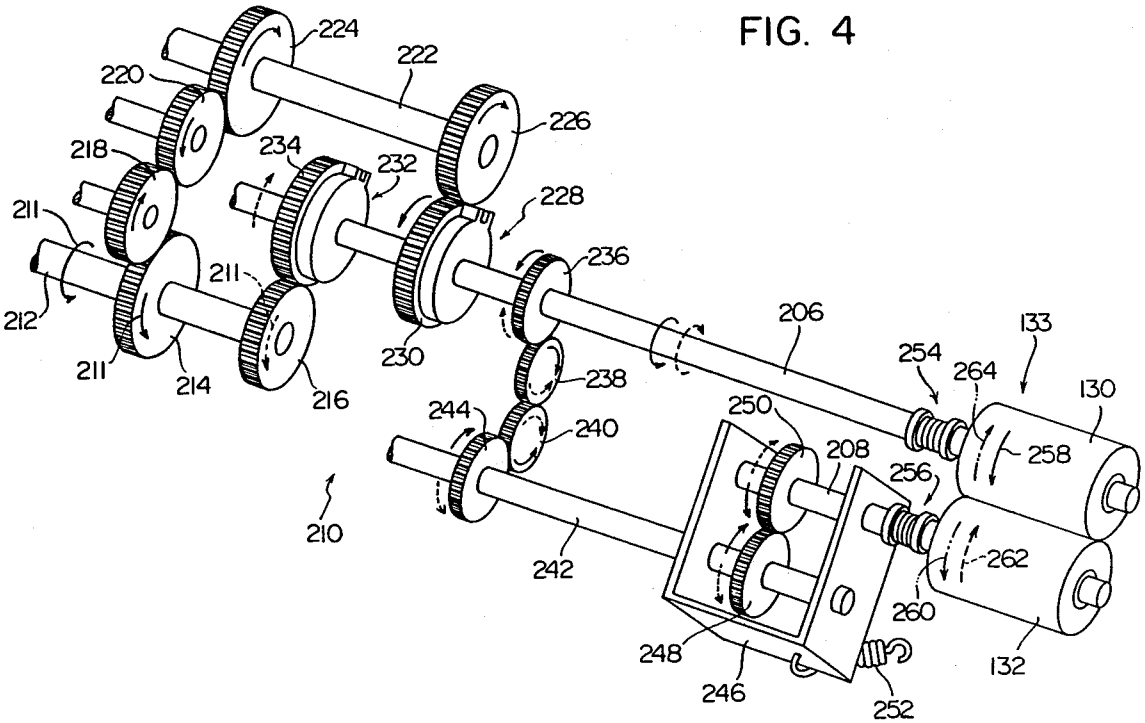
FIG. 4 is a perspective view showing in a simplified form overlapping feed preventing means and a driving system therefore in the paper re-feed means of FIG. 2.

The illustrated overlapping feed preventing means 133 will be described with reference mainly to FIG. 4.

The first roller 130 of the overlapping feed preventing means 133 is mounted on a shaft member 206 positioned on an upper side, and the second roller 132, on a shaft member 208 positioned on a lower side. The first roller 130 and the second roller 132 are adapted to rotate via a driving system 210 as will be described hereinafter. Gears 214 and 216 are attached to a shaft member 212 to be rotated in the direction shown by an arrow 211 and acting as an input shaft. One gear 214 is kept in mesh with a gear 224 mounted on a shaft member 222 via gears 218 and 220. A gear 226 is attached to shaft member 222, and is kept in mesh with an input gear 230 of a first electromagnetic clutch means 228 mounted on the shaft member 206. The other gear 216 is in mesh with an input gear 234 of a second electromagnetic clutch means 232 mounted on the shaft member 206. Hence, upon energization of the first electromagnetic clutch means 228, the driving force from the shaft member 212 is transmitted to the shaft member 206 via the gears 214, 218, 220, 224, 226 and 230. On the other hand, when the second electromagnetic clutch means 232 is energized, the driving force from the shaft member 212 is transmitted to the shaft member 206 via the gears 216 and 234. A gear 236 is further mounted on the shaft member 206, and is kept in mesh with a gear 244 mounted on a shaft member 242 via gears 238 and 240. A substantially ]-shaped support 246 is pivotably mounted on the shaft member 242, and the shaft member 208 is rotatably mounted on the support 246. A gear 248 mounted on the shaft member 242 is in mesh with a gear 250 mounted on the shaft member 208. Furthermore, a coil spring 252 is interposed between the support 246 and part of the copying paper, and biases the support 246 counterclockwise as viewed from right bottom in FIG. 4. In other words, the coil spring 252 biases the second roller 132 toward the first roller 130. In the illustrated embodiment, the first roller 130 is mounted on the shaft member 206 via a first torque limiter mechanism 254, and the second roller 132, on the shaft member 208 via a second torque limiter mechanism 256. The first torque limiter mechanism 254 (or the second torque limiter mechanism 256) is known per se, and can be constructed, for example, of a combination of a driving boss member rotating as a unit with the shaft member 206 (or 208), a follower boss member rotatable relative to the shaft member 206 (or 208), and a coil spring put over the driving boss member and the follower boss member. The first roller 130 (or the second roller 132) is mounted on the follower boss member so as to rotate as a unit with it. The first torque limiter mechanism 254 and the second torque limiter mechanism 256 are nearly the same as those disclosed, for example, in Japanese Laid-Open Utility Model Publication No. 96333/1985). The winding direction of the coil spring in the first torque limiter mechanism 254 is opposite to that of the coil spring in the second torque limiter mechanism 256.

Now, with reference to FIGS. 2, 3-A, 3-B and 4, the operation and advantage of the paper re-feed means 119 mentioned above will be described.

When a copying paper having an image formed on one surface is to be conducted to the paper receiving stand 150 through the paper returning passage, the paper refeed means 119 is in the state shown by solid lines in FIG. 2. Specifically, the electromagnetic solenoids 180 and 196 are in the deenergized state, the feed roller 174 of the first feed means 160 is held in the aforesaid operative state, and the feed roller 190 of the second feed means 162 is held in the aforesaid non-operative state. Thus, when as stated above, the copying paper having an image formed on one surface is conducted to the paper receiving stand 150 through the paper returning passage and moved over the paper receiving stand 150 to the feed roller 174, the feed roller 174 acts on the upper surface of the copying paper. As a result, the copying paper is moved toward the hampering piece 168 by the action of the feed roller 174 rotating in the direction shown by arrow 172. When the leading edge of the copying paper is moved to the hampering piece 168 at the operative position, it abuts against the hampering piece 168 to hamper the movement of the copying paper. Upon abutting, slippage is created between the paper and the feed roller 174 and the paper is accurately stopped without bending.

When the copying paper is thus received, the electromagnetic solenoid 180 is energized, and then a pair of width matching members (not shown) are moved reciprocatingly in the widthwise direction of the copying paper (the direction perpendicular to the sheet surface in FIGS. 1 and 2). When the electromagnetic solenoid 180 is energized, the oscillating arm 178 is pivoted in the direction shown by an arrow 186 (FIG. 2). Consequently, the feed roller 174 is held in the aforesaid non-operative state, and moves upwardly away from the copying paper on the paper receiving stand 150. Thereafter, the pair of width matching members (not shown) are caused to reciprocate and by the action of the width matching members, the widthwise position of the copying paper is adjusted. After the adjustment of the widthwise position of the paper is achieved, the electromagnetic solenoid 180 is deenergized (and therefore, the feed roller 174 is again brought into the aforesaid operative state). The above operation is repeated, and a required number of copying paper sheets are stacked on the paper receiving stand 150 as shown in FIG. 2.

At the time of paper receiving as described above, the first and second electromagnetic clutch means 228 and 232 of the overlapping feed preventing means 133 are deenergized, and therefore, the first roller 130 and the second roller 132 are kept from rotating.

When the paper sheets received in the stacked state on the paper receiving stand 150 are fed one by one from the uppermost one, the paper re-feed means 119 is in a first feeding condition shown in FIG. 3-A. Specifically, the electromagnetic solenoid 180 is deenergized, and the first feed means 160 is held in the aforesaid operative state. Furthermore, the electromagnetic solenoid 196 is deenergized to hold the second feed means 162 in the aforesaid non-operative state. Moreover, the hampering piece 168 is brought to the non-operative position from the above operative position. In addition, the first electromagnetic clutch means 128 in the overlapping feed preventing means 133 is energized.

When the electromagnetic solenoid 180 is deenergized, the feed roller 174 rotating in the direction of arrow 172 acts on the uppermost copying paper in the stack to feed the uppermost paper toward the overlapping feed preventing means 133. When the first electromagnetic clutch means 128 is energized, the driving force of the gear 214 rotating in the direction of arrow 211 is transmitted to the shaft member 206 via the gears 218, 220, 224, 226 and 230 rotating as shown by solid line arrows to rotate the shaft member 206 as shown by a solid line arrow. With this, the first roller 130 is also rotated in the direction of arrow 258 via the first torque limiter mechanism 254 (see FIG. 3-A also). When the shaft member 206 is so rotated, its driving force is transmitted to the shaft member 208 via the gears 236, 238, 240, 244, 248 and 250 rotating as shown by solid line arrows, and the shaft member 208 is rotated as shown by a solid line arrow. Accordingly, when the uppermost paper is fed as mentioned above, the driving force of the shaft member 208 is not transmitted to the second roller 132 via the second torque limiter mechanism 256. The second roller 132 moves following the rotation of the first roller 130 in the direction of arrow 258, and the uppermost paper is conveyed toward the paper conveying passage by the action of the first roller 130 and the second roller 132. On the other hand, when a plurality of copying paper sheets are fed from the top of the stack, the coil spring in the second torque limiter mechanism 256 contracts, and the driving force of the shaft member 208 is transmitted to the second roller 132 via the second torque limiter mechanism 256. Thus, the second roller 132 rotates in the direction shown by an arrow 260 indicated by a two-dot chain line. As a result, the first roller 130 acts on the uppermost paper to feed it toward the paper conveying passage. The second roller 132, on the other hand, acts on the paper beneath the uppermost one and sends it back to the paper receiving stand 150, and only the uppermost paper is fed toward the paper conveying passage by the first roller 130.

On the other hand, when the copying paper sheets received in the stacked state on the paper receiving stand 150 are to be fed one by one from the lowermost one, the paper re-feed means 119 is in a second feed condition shown in FIG. 3-B. Specifically, the electromagnetic solenoid 180 is energized and the first feed means 160 is held in the aforesaid non-operative state. At the same time, the electromagnetic solenoid 196 is energized to hold the second feed means 162 in the aforesaid operative state. Moreover, the hampering piece 168 is brought to the above non-operative position from the operative position. In addition, the second electromagnetic clutch means 232 in the overlapping feed preventing means 133 is energized.

Upon energization of the electromagnetic solenoid 196, the feed roller 190 acts on the lowermost paper in the stack, and by the action of the feed roller 190 rotating in the direction of arrow 188, the lowermost paper is fed toward the overlapping feed preventing means 133. When the second electromagnetic clutch means 232 is energized, the driving force of the gear 216 rotating in the direction of arrow 211 shown by a broken line is transmitted to the shaft member 206 via the gear 234 to rotate the shaft member 206 as shown by a broken line arrow. The driving force of the shaft member 206 is further transmitted to the shaft member 208 via the gears 236, 238, 240, 244, 248 and 250 rotating as shown by broken line arrows. With it, the second roller 132 is also rotated in the direction of arrow 262 shown by a broken line via the second torque limiter mechanism 256 (see FIG. 3-B also). Hence, when the lowermost paper is fed as above, the driving force of the shaft member 206 is not transmitted to the first roller 130 via the first torque limiter mechanism 254. The first roller 130 moves following the action of the second roller 132 rotating in the direction of arrow 262 shown by the broken line, and the lowermost paper is conveyed toward the paper conveying passage by the action of the second roller 132 and the first roller 130. On the other hand, when a plurality of copying paper sheets are fed from the bottom of the stack, the coil spring of the first torque limiter mechanism 254 contracts and the driving force of the shaft member 206 is transmitted to the first roller 130 via the first torque limiter mechanism 254 to rotate the first roller 130 in the direction shown by an arrow 264 indicated by a two-dot chain line. Consequently, the second roller 132 acts on the lowermost paper and conveys it toward the paper conveying passage. On the other hand, the first roller 130 acts on the paper existing above it and sends it back to the paper receiving stand 150. Only the lowermost paper is fed toward the paper conveying passage by the action of the second roller 132.

Accordingly, in the paper re-feed means 119 having the structure described above, copying paper sheets received in the stacked state on the paper receiving stand 150 can be fed accurately one by one successively from the top or the bottom of the stack.

Since the paper re-feed means 119 is of such a structure that copying paper sheets are received in the stacked state and then fed one by one, its first feed means 160 can be constructed for example, as shown in the specification and drawings of Japanese Patent Application No. 207940/1984 (entitled: ELECTROSTATIC COPYING APPARATUS). Specifically, it may be constructed such that the oscillating arm is actuated by two electromagnetic solenoids, and the feed roller is held in a first operative state (in which it acts on the copying paper relatively weakly) when the two electromagnetic solenoids are deenergized; it is held in a non-operative state (in which it moves away from the copying paper) when one of the electromagnetic solenoids is energized; and that it is held in a second operating state (in which it acts on the copying paper relatively strongly) when the other electromagnetic solenoid is energized.

Structure of Document Sending Device in the First Embodiment

Again, with reference to FIG. 1, the document sending device disposed on the upper surface of the main copying system 2 will be described. The illustrated document sending device 3 has a nearly box-like housing 270. An intermediate portion of the housing 270 in the left-right direction is slightly lower than both its end portions, and an intermediate upper wall 272 acts both as a document receiving stand on which documents to be copied are placed and as a document discharge section to which the documents after exposure are discharged. Document feeding means 274 is provided at the right end portion of the intermediate upper wall 272. The document feeding means 274 is disposed at the upper end of the housing 270 so as to act on the under surfaces of the documents placed on the upper surface of the intermediate upper wall 272 and includes of a pair of rollers 276 and 278 and a feed belt 280 wrapped over these rollers 276 and 278. Above the roller 278, a separation roller 282 for preventing overlapping feed of documents is provided. As will be described in detail hereinafter, the feed belt 280 is moved in the direction shown by an arrow 284, and the separation roller 282 cooperating with the feed belt 280 is rotated in the direction shown by an arrow 286.

Documents fed from the document feeding means 274 are conveyed through the exposure area on the transparent plate 6 in the main copying system 2 by the action of a document conveying means 288. The illustrated document conveying means 288 is provided with a conveyor belt mechanism 290 having a pair of rollers 292 and 294 disposed on both sides of the transparent plate 6 and an endless belt 296 wrapped over the pair of rollers 292 and 294.

The documents exposed in the exposure area are then discharged onto the intermediate upper wall 272 by the action of a first document discharge means 298 defining a first document discharge passage or a second document discharge means 300 defining a second document discharge passage. The illustrated first document discharge means 298 includes a pair of conveyor rollers 302 and a pair of discharge rollers 304. The second document discharge means 300 includes a pair of conveyor rollers 306, a reversal conveying mechanism 308, a pair of conveyor rollers 310 and the pair of discharge rollers 304. The reversal conveying mechanism 308 has an intermediate roller 314 to be rotated in the direction shown by an arrow 312, a first roller 316 and a second roller 318 cooperating with the intermediate roller 314, a pair of document holding plates 320 and a returning roller 322. The returning roller 322 is adapted to be rotated in the direction shown by an arrow 324 and is free to move between a non-operative position shown by a solid line in FIG. 1 (at which it moves away from the pair of document holding plates 320) and an operative position shown by a two-dot chain line in FIG. 1 (at which it projects between the pair of document holding plates 320 and acts on the document held by these plates).

In the illustrated document sending device 3, a document conveyance switching means 326 is further disposed downstream of the conveyor belt mechanism 290. The document conveyance switching means 326 comprises a switching guide member 328 adapted to be held selectively at a first position shown by solid lines in FIG. 1 and a second position shown by two-dot chain lines in FIG. 1. The switching guide member 328 is held at the first position when the documents are discharged through the first document discharge passage, and at the second position when the documents are discharged through the second document discharge passage.

Conveyance of documents by the document sending device 3 of the described structure and its relation to image formation on copying paper will be described below.

Figure 5:
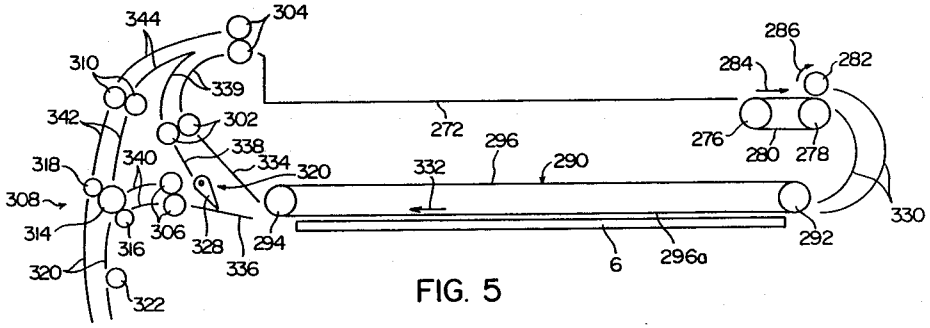
FIG. 5 is a simplified view illustrating the conveyance of a document when one surface of the document is to be copied on one surface of copying paper using the electrostatic copying apparatus of FIG. 1.
Figure 6:
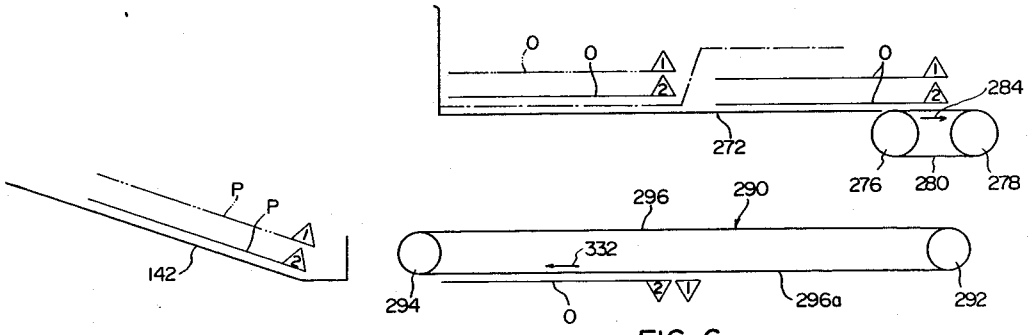
FIG. 6 is a simplified view illustrating the relationship among documents placed on a document receiving stand, documents discharged to a document discharge section, and copying papers discharged onto a receiving tray in the case shown in FIG. 5.

When one surface of a document is to be copied on one surface of copying paper in the first embodiment With reference to FIGS. 5 and 6, the document conveyance and its relation to image formation on copying paper will be described with reference to the case where one surface of each document is to be copied on one surface of each copying paper. In the following description, surfaces of a document to be copied and surfaces of copying paper on which to form an image are numbered to facilitate understanding.

When one surface of a document 0 is to be copied, documents 0 are placed on the intermediate upper wall 272 (functioning as a document receiving stand) so that the surfaces to be copied face upward and the final document (e.g. the last page) is located at the lowermost position. The documents 0 so placed are fed toward the exposure area on the transparent plate 6 by the action of the document feeding means 274. Specifically, the documents 0 undergo the feeding action of the feed belt 280 moving in the direction of arrow 294 and the separating action of the separation roller 282 rotating in the direction of arrow 286 and are fed successively from the bottom of the document stack on the intermediate upper wall 272.

The document 0 fed from the intermediate upper wall 272 is introduced between the transparent plate 6 of the main copying system 2 and the lower travelling section **296*a* of the conveyor belt 296 via guide plates 330, and positioned in the exposure area on the transparent plate 6 by the action of the lower travelling section 296*a* moving in the direction of arrow 332, (when the document 0 is positioned in the exposure area, the movement of the conveyor belt 296 is stopped). When the document 0 is thus positioned, that surface of the document 0** which is to be copied faces downward and is thus scanned and exposed as described hereinabove.

Thereafter, the lower travelling section **296*a* of the conveyor belt 296 is moved in the direction shown by arrow 332, and the document 0 on the transparent plate 6 is discharged onto the intermediate upper wall 272 (functioning also as a document discharge portion) through the first document discharge passage. Specifically, since at this time the switching guide member 328 is held at the first position, the document 0 on the transparent plate 6 is conveyed to the conveyor rollers 302 advancing between a guide plate 334 and a guide plate 336, the switching guide member 328 at the first position and a guide plate 338 by the action of the conveyor belt 296. It is then conveyed between a pair of guide plates 339 to the pair of discharge rollers 304, and by the action of the discharge rollers 304, discharged onto the intermediate upper wall 272. As can be seen from FIG. 5, the document 0 in the illustrated embodiment is substantially reversed (turned upside down) while it is conveyed from the intermediate upper wall 272 to the transparent plate 6. Thereafter, during conveyance from the transparent plate 6 to the intermediate upper wall 272, it is also substantially reversed. Hence, the document 0 scanned and exposed in the exposure area is discharged onto the intermediate upper wall 272** with its copied surface facing upward.

When it is desired to copy one surface of document 0 on one surface of copying paper P in the electrostatic copying apparatus equipped with the document sending device 3, documents 0 are placed on the intermediate upper wall 272 such that the surfaces to be copied face upward and the final document 0 (e.g. the last page) is located at the lowermost position. In this regard, the following points must be noted in. As can be seen from FIG. 6, the second document 0, for example, is first conveyed from the intermediate upper wall 272 to the exposure area on the transparent plate 6 with its surface to be copied (indicated by symbol 2 in FIG. 6) facing downward, and following the scanning exposure of the second document 0, the first document 0 is conveyed to the exposure area with its surface to be copied (indicated by symbol 1 in FIG. 6) facing downward. The documents 0 so conveyed are discharged as follows. First, the second document 0 is discharged onto the intermediate upper wall 272 with its copied (exposed) surface facing upward, and thereafter, the first document 0 is discharged onto the second document 0 with its copied surface facing upward. Hence, the documents 0 discharged onto the intermediate upper wall 272 are sequenced with the first one at the top and the copied surfaces facing upward, and no sequencing of the documents is necessary after the copying operation. Copying of the documents 0 starts with the second document 0 in the above-mentioned case, and copying papers P having images formed thereon are discharged onto the document receiving tray 142 as follows. First, copying paper P bearing an image corresponding to the second document 0 is discharged onto the receiving tray 142 with its image-bearing surface (indicated by symbol 2 in FIG. 6) facing upward. Thereafter, copying paper bearing an image corresponding to the first document 0 is discharged with its image-bearing surface (indicated by symbol 1 in FIG. 6) facing upward (see FIG. 1 also). Hence, the copying papers P discharged onto the receiving tray 142 are also sequenced with the first one at the top and the image-bearing surfaces facing upwardly, and there is no need to sequence the copies after the copying operation.

Figure 7:
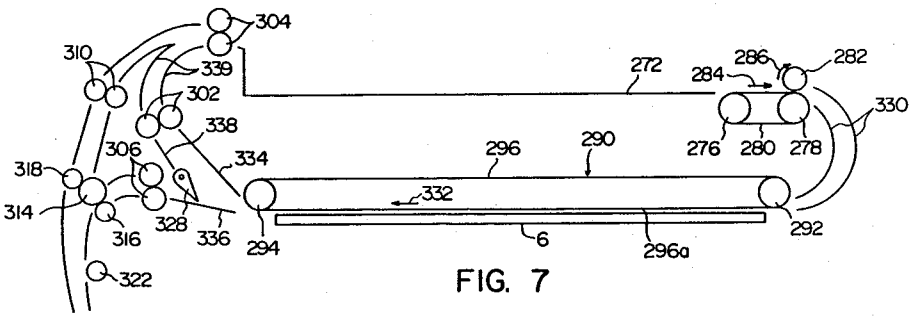
FIG. 7 is a simplified view illustrating the conveyance of a document when one surface of a document is to be copied on both surfaces of copying paper using the electrostatic copying apparatus shown in FIG. 1.

When one surface of a document is to be copied on both surfaces of copying paper in the first embodiment Now, with reference to FIGS. 7 and 8, conveyance of documents and its relation to image formation on copying paper will be described with regard to the case where one surface of a document 0 and one surface of the next document are to be successively copied on both surfaces of copying paper.

Figure 8:
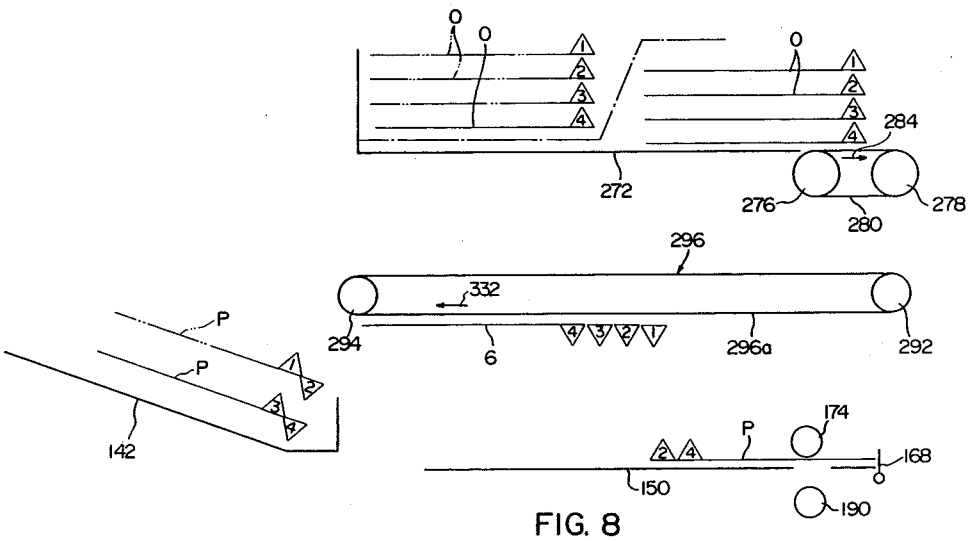
FIG. 8 is a simplified view illustrating the relation among documents placed on the document receiving stand, copying papers received in paper re-feed means, documents discharged to the document discharge section, and copying papers discharged onto the receiving tray in the case shown in FIG. 7.

When one surface of document 0 is to be copied, documents 0 to be copied are placed on the intermediate upper wall 272 such that the surfaces to be copied face upward and the final document 0 (e.g. the last page) is located at the lowermost position, as shown in FIG. 8. The documents 0 so placed are fed toward the exposure area on the transparent plate 6 by the action of the document feeding means 274 as described hereinabove. Specifically, the docoments 0 on the intermediate upper wall 272 are fed successively from the lowermost one by the feeding action of the feed belt 280 moving in the direction of arrow 284 and the separating action of the separation roller 282 rotating in the direction of arrow 286.

Document 0 fed from the intermediate upper wall 272 advances between the pair of guide plates 330 and is introduced between the transparent plate 6 and the lower travelling section 296*a* of the conveyor belt 296 and is positioned in the exposure area on the transparent plate 6 by the action of the lower travelling section 296*a* moving in the direction of arrow 332. When the document 0 is thus positioned, that surface of the document which is to be copied faces downward, and is thus scanned and exposed as shown in FIG. 8.

Thereafter, the lower travelling section 296*a* of the conveyor belt 296 is moved in the direction of arrow 332, and the document 0 on the transparent plate 6 is conducted to the switching guide member 328 at the first position through the first document discharge passage and discharged onto the intermediate upper wall 272 by the action of the pair of conveyor rollers 302 and the pair of discharge rollers 304. It will be seen from FIG. 7 that in this case, the document 0 is substantially reversed (turned upside down) during conveyance from the intermediate upper wall 272 to the transparent plate 6, and is further reversed during conveyance from the transparent plate 6 to the intermediate upper wall 272. Hence, the document 0 scanned and exposed in the exposure area is discharged onto the intermediate upper wall 272 with its copied surface facing upward.

When it is desired to copy one surface of a document and one surface of the next document successively on both surfaces of the copying paper in the electrostatic copying apparatus equipped with the document sending device 3, documents 0 are placed on the intermediate upper wall 272 such that one surface to be copied faces upward and the final document 0 (e.g. the last page) is located at the lowermost position. In relation to this, the following points should be noted. As can be understood from FIG. 8, the fourth document 0, for example, is conveyed first to the exposure area on the transparent plate 6 with its surface to be copied (indicated by symbol 4 in FIG. 8) downward, and following the exposure of the fourth document 0, the third document 0 is conveyed to the exposure area on the transparent plate 6 with its surface to be copied (indicated symbol 3 in FIG. 8) facing downward. Subsequently, the second document (its surface to be copied is indicated by symbol 2 in FIG. 8) is conveyed and then the first document 0 (its surface to be copied is indicated by symbol 1 in FIG. 8) is conveyed. Hence, the documents 0 so conveyed are discharged as follows. First, the fourth document 0 is discharged onto the intermediate upper wall 272 with its copied surface (exposed surface) facing upward. Then, the third document 0 is discharged onto the fourth document 0 with its copied surface facing upward. Then, the second document is discharged onto the third document 0 in the same manner, and finally the first document 0 is likewise discharged onto the second document 0. Hence, as shown in FIG. 8, the documents 0 discharged onto the intermediate upper wall 272 are sequenced with the first one at the top, and there is no need to sequence the documents 0 after the copying operation. The documents 0 to be copied are successively copied on both surfaces of the copying paper P starting with the fourth document, and the copying papers P having in image formed on both surfaces are discharged onto the receiving tray 142 in the following manner. First, during conveyance through the paper conveying passage, an image corresponding to the fourth document 0 is formed on one surface of copying paper P, and the copying paper P is received by the paper receiving stand 150 with its image-bearing surface (marked by symbol 4 in FIG. 8) facing upward. Then, by the action of the feed roller 174 of the first feed means 160 (alternatively, the feed roller 190 of the second feed means 162), the copying paper P is fed from the paper receiving stand 150. During reconveyance through the paper conveying passage, an image corresponding to the third document 0 is formed on the other surface of the copying paper P. The copying paper P having images formed on both surfaces is discharged onto the receiving tray 142 (see FIG. 1 also) with its surface bearing the image corresponding to the third document 0 (the surface marked by symbol 3 in FIG. 8) facing upward. Then, during conveyance of the next copying paper P through the paper conveying passage, an image corresponding to the second document 0 is formed on one surface of this copying paper, and this copying paper P is also received on the paper receiving stand 150 with its image-bearing surface (marked by symbol 2 in FIG. 8) facing upward. Subsequently, in the same manner as described above, during re-conveyance of this next copying paper P through the paper conveying passage, an image corresponding to the first document is formed on the other surface of this copying paper. The copying paper fed next and having images on both surfaces is discharged onto the first copying paper discharged onto the receiving tray 142 with its surface bearing the image corresponding to the first document 0 (the surface indicated by symbol 1 in FIG. 8) facing upward. Accordingly, the copying papers discharged onto the receiving tray 142 are sequenced with the formation of the image corresponding to the first document 0, the image corresponding to the second document 0, the image corresponding to the third document 0, and the image corresponding to the fourth document on the copying papers starting with the upper surface of the uppermost copying paper. There is no need to sequence the copies after the copying operation.

When both surfaces of a document are to be copied on both surfaces of copying paper in the first embodiment Conveyance of documents and its relation to image formation on copying papers will now be described with reference to FIG. 9-A and 9-B and 10-A to 10C in regard to the case where both surfaces of a document are to be successively copied on both surfaces of copying paper.

When both surfaces of a document 0 are to be copied, documents 0 to be copied are placed on the intermediate upper wall 272 such that the first pages of the documents 0 faces upward and the final document 0 is located at the lowermost position. The documents 0 so placed are discharged onto the intermediate upper wall 272 after being conveyed through the exposure area and the second document discharge passage as shown in FIG. 9-A, and by this pre-conveyance the documents are relocated. Specifically, the switching guide member 328 is held at the second position and therefore, the documents 0 fed from the lowermost position of the document stack by the feeding action of the feed belt 280 moving in the direction of arrow 284 and the separating action of the separation roller 282 rotating in the direction of arrow 286 advance between the pair of guide plates 330 and are introduced between the transparent plate 6 and the lower travelling section 296*a* of the conveyor belt 296, then are conveyed to the pair of conveyor rollers 306 from the exposure area and the space between the guide plate 336 and the switching guide member 328 held at the second position, and further to the reversal conveying mechanism 308 via the space between guide plates 340. In the reversal conveying mechanism 308, the intermediate roller 314 is rotated in the direction of arrow 312. Hence, the document 0 conveyed via the space between the pair of guide plates 340 is conducted to the space between the document holding plates 320 by the action of the intermediate roller 314 and the first roller 316 (at this time, the returning roller 322 is held at the non-operative position shown by a solid line in FIG. 9-A), and does not substantially act on the document 0 introduced between the document holding plates 320). When the trailing end of the document 0 so introduced goes past the nipping site of the intermediate roller 314 and the first roller 316, the returning roller 322 is held at the operative position shown by a two-dot chain line in FIG. 9-A. As a result, the document 0 positioned between the document holding plates 320 from its rear end side is conducted to the nipping site of the intermediate roller 314 and the second roller 318 by the action of the returning roller 322 rotating in the direction of arrow 324, with its leading and trailing ends being reversed. Then, by the action of the intermediate roller 314 and the second roller 318, the document 0 is conveyed through a pair of guide plates 342, the pair of conveyor rollers 310 and a pair of guide plates 344, and is discharged onto the intermediate upper wall 272 by the discharge rollers 304. Accordingly, when this pre-conveyance is carried out, the documents 0 originally placed so that their first pages face upward and the final document 0 is located at the lowermost position are relocated as a result of being conveyed through the second document discharge passage having the reversal conveying mechanism 308 disposed therein, and the documents are now placed so that their second pages face upward and the final document 0 is located at the lowermost position.

After the end of the pre-conveyance, the relocated documents 0 are re-conveyed through the exposure area and the second document discharge passage in the same manner as described above, and in the exposure area, the second pages of the documents 0 are scanned and exposed. Specifically, the documents 0 placed so that their second pages to be copied face upward and the final document 0 is located at the lowermost position are successively fed from the bottom of the stack by the action of the feed belt 280 and the separation roller 282. Each document 0 so fed is introduced between the transparent plate 6 and the lower travelling section 296*a* of the conveyor belt 296 and positioned in the exposure area on the transparent plate 6, (when the document 0 is positioned in the exposure area, the movement of the conveyor belt 296 is stopped). When the document 0 is thus positioned, its second page to be copied faces downward and is scanned and exposed in the same manner as described above.

Thereafter, the lower travelling section 296*a* is moved in the direction of arrow 332, and the document 0 on the transparent plate 6 is conducted to the reversal conveying mechanism 308 while being guided by the switching guide member 328 held at the second position. By the aforesaid action of the reversal conveying mechanism 308, the leading and trailing ends of the document again are reversed and it is discharged onto the intermediate upper wall 272 through the second document discharge passage. After the documents 0 have thus been discharged after the exposure of their second pages, the documents are further relocated so that their first pages face upward and the final document is located at the lowermost position (namely, the original state of document positioning again is achieved) as a result of re-conveyance through the second document discharge passage, as shown in FIG. 10-B.

After the second pages of the documents 0 have been copied, the documents 0 again relocated are conveyed through the exposure area and the first document discharge passage in order to copy their pages. Specifically, as shown in FIG. 10-C, the documents 0 again relocated so that their first pages to be copied face upward and the final document 0 is located at the lowermost position are successively fed from the bottom of the stack by the action of the feed belt 280 and the separation roller 282. Each document 0 so fed is introduced between the transparent plate 6 and the lower travelling section 296*a* of the conveyor belt 296 and again positioned in the exposure area (when the document is positioned in the exposure area, the moving of the conveyor belt 296 is stopped). When the document 0 is thus positioned, its first page faces downward and is scanned and exposed as described above.

Thereafter, the lower travelling section 296*a* of the conveyor belt 296 is moved in the direction of arrow 332, and the document on the transparent plate 6 is guided by the switching guide member 328 held at the first position and discharged onto the intermediate upper wall 272 through the first document discharge passage. As a result of having been discharged through the first document discharge passage, the documents 0 discharged on the intermediate upper wall 272 assume the same condition as that in which they are originally placed on the intermediate upper wall 272. In other words, the discharged documents 0 are sequenced from the final document 0 at the bottom with their first pages facing upward.

When it is desired to copy both surfaces of the document 0 on both surfaces of copying paper P in the electrostatic copying apparatus equipped with the document sending device 3, the documents 0 to be copied are placed so that their first pages face upward and the final document 0 is located at the lowermost position. After pre-conveyance of the document 0, the second pages of the documents 0, and then their first pages, are copied. In relation to this feature, the following points should be noted. As can be understood from FIGS. 10-A to 10-C, in the pre-conveyance, the third document 0, for example, is conveyed from the intermediate upper wall 272 and passes through the exposure area with its first page (indicated by symbol 5 in FIGS. 10-A to 10-C) downward, and thereafter is discharged through the second discharge passage. The second document 0 then passes through the exposure area with its first page (indicated by symbol _3_ in FIGS. 10-A to 10-C) downward and is then discharged through the second document discharge passage. Subsequently, the first document passes through the exposure area with its first page (indicated by symbol 1 in FIGS. 10-A to 10-C) downward, and is discharged through the second document discharge passage. Thereafter, when the second page of the document 0 is to be copied, the third document 0, for example, is positioned in the exposure area with its second page (indicated by symbol 6 in FIGS. 10-A to 10-C) facing downward and then is discharged through the second document discharge passage. Thereafter, the second document 0 is positioned in the exposure area with its second page (indicated by symbol 4 in FIGS. 10-A to 10-C) downward, and then is discharged through the second document discharge passage. Subsequently, the first document 0 is positioned in the exposure area with its second page (indicated by symbol 2 in FIGS. 10-A to 10-C) downward, and then is discharged through the second document discharge passage. In the subsequent copying of the first page of the document 0, the third document 0 is positioned in the exposure area with its first page downward, and then is discharged through the first document discharge passage. Then, the second document 0 is positioned with its first page downward, and then is discharged through the first document discharge passage. Thereafter, the first document is positioned in the exposure area with its first page downward, and is discharged through the first document discharge passage. Accordingly, after the copying operation, the documents 0 discharged onto the intermediate upper wall 272 are sequenced from the first one at the top with their first pages facing upward and their second pages facing downward as shown in FIG. 10-C, and there is no need at all to sequence the copied documents 0 after the end of the copying operation.

In relation to the conveyance of the documents 0 as above, the copying papers P having images formed on both surfaces are discharged as follows. First, during conveyance through the paper conveying passage, an image corresponding to the second page of the third document 0 is formed on one surface of copying paper P, and the copying paper P is received on the paper receiving stand 150 with its image-bearing surface (indicated by symbol _6_ in FIGS. 10-B and 10-C) facing upward. Thereafter, while the next copying paper P is conveyed through the paper conveying passage, an image corresponding to the second page of the second document is formed on one surface of this next paper P. This copying paper is received on the first paper P on the paper receiving stand 150 with its image-bearing surface (indicated by symbol 4 in FIGS. 10-B and 10-C) upward. Subsequently, while another copying paper P is conveyed through the paper conveying passage, an image corresponding to the second page of the first document is formed on one surface of this copying paper. The copying paper is then received on the aforesaid next copying paper on the paper receiving stand 150 with its image-bearing surface (indicated by symbol _2_ in FIGS. 10-B and 10-C) upward. In the case of both-surface copying, the copying papers P received in the paper receiving stand 150 are fed one by one from the lowermost one by the action of the feed roller 190 of the second feed means 162. When the lowermost copying paper P (having formed on one surface an image corresponding to the second page of the third document 0) is fed from the paper receiving stand 150 and re-conveyed through the paper conveying passage, an image corresponding to the first page of the third document is formed on its other surface during this re-conveyance, and this copying paper P having copied images on both surfaces is discharged onto the receiving tray 142 with its other surface (indicated by symbol 5 in FIGS. 10-B and 10-C) facing upward. From the paper receiving stand 150, the next copying paper P (having formed on one surface thereof the image corresponding to the second page of the second document 0) is fed and again conveyed through the paper conveying passage, an image corresponding to the first page of the second document is formed on the other surface during re-conveyance, and this copying paper P is discharged onto the preceding copying paper P received on the receiving tray with its other surface (indicated by symbol _3_ in FIGS. 10-B and 10-C) facing upward. From the paper receiving stand 150, the next copying paper P (having formed on one surface thereof the image corresponding to the second page of the first document 0) is fed and again conveyed through the paper conveying passage, an image corresponding to the first page of the first document is formed on the other surface during re-conveyance. This copying paper P is then discharged onto the copying paper P on the receiving tray 142 with its other surface (indicated by symbol 1 in FIGS. 10-B and 10-C) facing upward. Accordingly, as shown in FIG. 10-C, the copying papers discharged onto the receiving tray 142 are sequenced with the surface bearing the image corresponding to the first page of each document facing upward and the copy corresponding to the first document 0 located at the top. It is unnecessary therefore to sequence the copies after the copying operation.

When paper jamming occurs during the copying operation

Now, with reference to FIGS. 11-A and 11-B, paper jamming during the copying operation will be described.

When paper jamming occurs during copying of the first page of the document 0 (during feeding from the paper receiving stand 150) in the case of copying both surfaces of document 0 on both surfaces of copying paper P, the copying is subsequently carried out as follows. First, the jamming paper is removed from the main copying system 2 of the copying apparatus, and a document corresponding to the removed paper is placed on the intermediate upper wall 272 (when documents 0 exist on the intermediate upper wall 272, it is desirable to remove them as shown in FIG. 11-A). For example, let us assume that three documents 0 are to be copied as shown in FIGS. 9-A and 9-B and FIGS. 10-A to 10-C and paper jamming has occurred during copying of the first page of the second document 0. In the illustrated embodiment as shown in FIG. 11-A, copying papers P corresponding to the third and second documents 0 are removed from the main copying system 2 of the copying apparatus, and in relation to this, the third and second documents 0 are placed on the intermediate upper wall 272 for re-copying. If at this time, the third copying paper P has already been discharged from the main copying system 2, only the copying paper P corresponding to the second document is to be removed from the main copying system 2. Hence, only the second document 0 is to be placed on the intermediate upper wall 272 for re-copying. The third and second documents 0 to be re-copied are placed on the intermediate upper wall 272 so that the second page of each document faces upward and the final document 0 is located at the uppermost position. The documents 0 so placed are fed from the lower one by the action of the document feeding means 274, positioned in the exposure area, and then discharged onto the intermediate upper wall 272 through the first document discharge passage. Specifically, in re-copying, the second page of the second document 0 (indicated by symbol 4 in FIGS. 11-A and 11-B) is first positioned in the exposure area, and subsequently, the second page of the third document 0 (indicated by symbol 6 in FIGS. 11-A and 11-B) is positioned in the exposure area. In the meantime, in the main copying system 2, a fresh copying paper P is conveyed through the paper conveying passage, and an image corresponding to the second page of the second document 0 is formed on one surface of the fresh copying paper P during conveyance. This copying paper P is then received onto copying papers P remaining on the paper receiving stand 150 (copying papers in which no copying is performed on the other surfaces because of paper jamming) with its one surface (indicated by symbol 4 in FIGS. 11-A and 11-B) facing upward. Then, while another fresh copying paper P is conveyed through the paper conveying passage, an image corresponding to the second page of the third document 0 is formed on its one surface. This copying paper P is received onto the new paper on the receiving stand 150 with its one surface (indicated by symbol 6 in FIGS. 11-A and 11-B) facing upward.

Thereafter, the documents discharged onto the intemediate upper wall 272 are substantially relocated so that the first page of each document faces upward and the final document 0 is located at the lowermost position as shown in FIG. 11-B, and the first pages of the documents are then copied. Specifically, the relocated documents 0 on the intermediate upper wall 272 are fed from the lowermost one by the action of the document feeding means 274. The first page (indicated by symbol 5 in FIGS. 11-A and 11-B) of the third document is first positioned in the exposure area. Then, the first page (indicated by symbol 3 in FIGS. 11-A and 11-B) of the second document 0 is positioned in the exposure zone. These documents 0 are discharged through the first document discharge passage in the same manner as described hereinabove. On the other hand, in the main copying system 2, new copying papers P corresponding to the documents 0 to be re-copied are fed one by one from the uppermost one by the action of the feed roller 174 of the first feed means 160. In copying the first page of the document 0 to be re-copied, the uppermost copying paper (having formed on one surface thereof the image corresponding to the second page of the third document 0) is fed from the paper receiving stand 150, and during conveyance through the paper conveying passage, an image corresponding to the first page of the third document 0 is formed on its other surface. The copying paper P thus having images formed on both surfaces is discharged onto the receiving tray 142 with its other surface (indicated by symbol 5 in FIG. 11-B) facing upward. Thereafter, the next copying paper P (having formed on one surface thereof the image corresponding to the second page of the second document 0) is conveyed, and during conveyance through the paper conveying passage, an image corresponding to the first page of the second document 0 is formed on the other surface of the next copying paper. The copying paper having images formed on both surfaces is discharged onto the above copying paper P on the receiving tray 142 with its other surface (indicated by symbols 3 in FIG. 11-B) facing upward.

After both surfaces of the documents 0 corresponding to the copying papers P removed from the main copying system 2 are copied, the first page of the remaining document 0, i.e. the first document 0, is copied as shown in FIG. 10-C.

By the aforesaid operations, the documents 0 are sequenced, in spite of paper jamming during copying, so that the first page of each document faces upward and the first document is at the top. There is no need at all to sequence the documents 0 after the copying operation. Furthermore, the copying papers P discharged onto the receiving tray 142 are also sequenced with the surface bearing the image corresponding to the first page of the document 0 facing upward and the copy corresponding to the first document 0 being located at the top. Accordingly, the discharged copies need not to be sequenced.

Incidentally, when paper jamming occurs in the case of copying one surface of a document on one surface of copying paper or copying one surface each of documents on both surfaces of copying paper, or during copying of the second page of a document in the case of copying both surfaces of a document on both surfaces of copying paper, a document corresponding to the copying paper removed from the main copying system 2 may be subsequently recopied as in the prior art.

Second Embodiment of the Electrostatic Copying Apparatus

Figure 12:
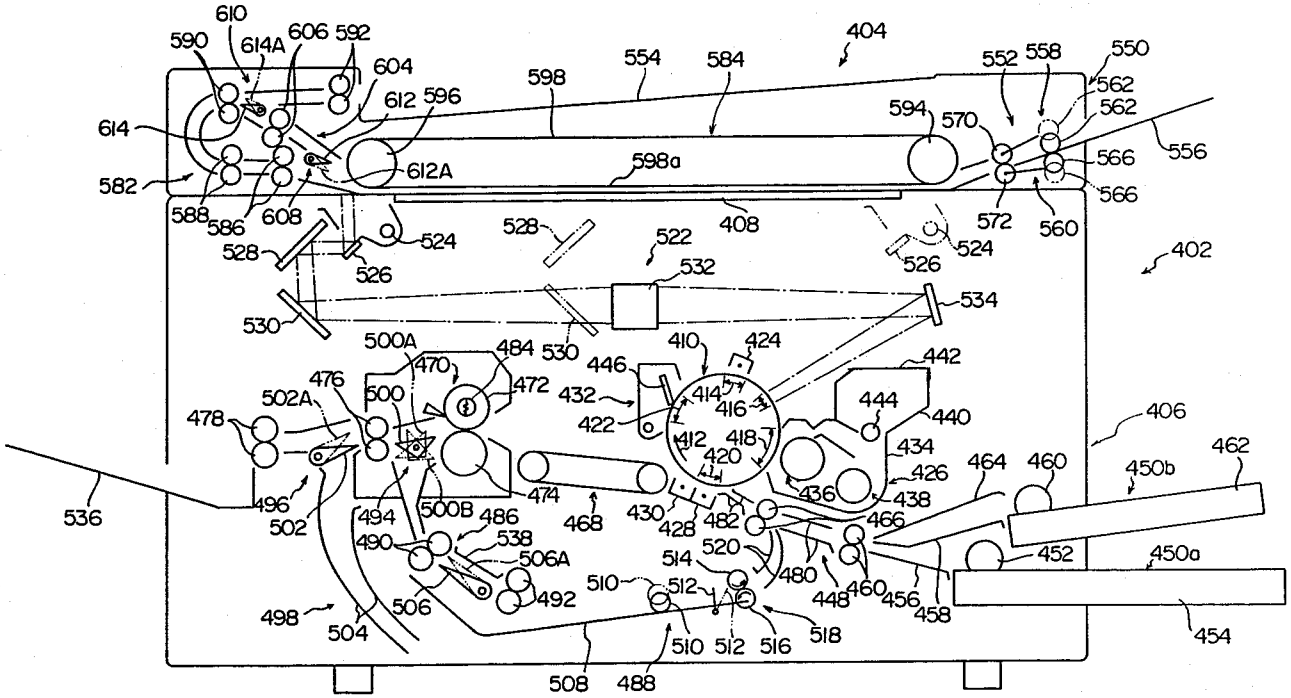
FIG. 12 is a sectional view showing in a simplified form a second embodiment of the electrostatic copying apparatus capable of copying on both surfaces of copying paper constructed in accordance with this invention.

Now, with reference to FIGS. 12 to 18, a second embodiment of the electrostatic copying apparatus in accordance with this invention will be described. In FIG. 12, the illustrated electrostatic copying apparatus includes a main copying system 402 and a document sending device shown generally at 404 and disposed on the upper surface of the main copying system 402.

Outline of the Main Copying System in the Copying Apparatus in the Second Embodiment With reference to FIG. 12, the main copying system 402 in the second embodiment has a parallelepipedal housing 406. A transparent plate 408 on which to place a document to be copied is disposed on the upper surface of the housing 406.

A rotating drum 410 is disposed rotatably in the nearly central part of the housing 406. Around the rotating drum 410 to be rotated in the direction shown by an arrow 412 are disposed a charging zone 414, an exposure zone 416, a developing zone 418, a transfer zone 420, and a cleaning zone 422 in this sequence as viewed in the rotating direction of the rotating drum 410. A charging corona discharge device 424 is provided in the charging zone 414. A developing device 426 is provided in the developing zone 418. A transfer corona discharge device 428 is provided in the transfer zone 420, and a peeling corona discharge device 430 is disposed downstream of the transfer corona discharge device 428. A cleaning device 432 is provided in the cleaning zone 422. The illustrated developing device 426 is equipped with a development receptacle 434 for holding a developer. A magnetic brush mechanism 436 is disposed within the development receptacle 434. An agitating mechanism 438 for agitating the developer is also disposed within the development receptacle 434.

A toner particle holding vessel 440 is mounted on the upper surface of the development receptacle. A closure 442 is mounted on the open upper surface of the vessel 440 for free opening and closing. A toner paritcle feed roller 444 is rotatably mounted on the bottom of the toner particle holding vessel 440. The cleaning device has a cleaning blade 446 acting on the surface of the photosensitive surface of the rotating drum 410.

Copying paper conveying means 448 defining a copying paper conveying passage is also disposed within the housing 406. Copying paper feed means is provided at its right end portion (in FIG. 12). In the illustrated embodiment, the paper feed means is comprised of a first copying feed device **450*a* and a second copying paper feed device 450*b* of the cassette type. The first paper feed device 450*a* is constructed of a cassette receiving section with a feed roller 452 and a copying paper cassette 454 to be detachably loaded into the cassette receiving section. By the action of the feed roller 452, copying paper sheets are fed one by one from a stack of paper sheets (not shown) held in the cassette 454. The copying paper fed from the cassette 454 is sent to a pair of conveyor rollers 460 after advancing between guide plates 456 and 458**.

The second paper feed device **450*b* is comprised of a combination of a cassette receiving section with a feed roller 460 and a copying paper cassette 462 to be detachably loaded into the cassette receiving section. By the action of the feed roller 460, paper sheets are fed one by one from a stack of paper sheets (not shown) held in the cassette 462. The copying paper fed from the cassette 462 is sent to the pair of conveyor rollers 460 through the space between guide plates 458 and 464**.

The illustrated copying paper conveying means 448 includes the pair of conveyor rollers 460, a pair of conveyor rollers 466, a conveyor belt mechanism 468, an upper roller 472 and a lower roller 474 a fixing device 470, and a pair of discharge rollers 478. These elements define a paper conveying passage extending in the left-right direction in FIG. 12. Hence, the copying paper fed to the conveyor rollers 460 from the paper feed means (the first paper feed device **450*a* or the second paper feed device 450*b*) is conveyed to the pair of conveyor rollers 466 through a pair of guide plates 480 by the action of the pair of conveyor rollers 460. Between guide plates 482 it is conveyed to the transfer zone 420 by the action of the pair of conveyor rollers 466. Then, the copying paper is conveyed by the action of the conveyor belt mechanism 468 and fed to a space between the upper roller 472 having a heater 484 disposed therein and the lower roller 474 kept in press contact with the upper roller 472**.

The illustrated apparatus further includes copying paper returning means 486 defining a copying paper returning passage, and downstream of the paper returning means 486 is disposed a copying paper re-feed means 488. The illustrated paper returning means 486 is provided with a pair of conveyor rollers 490 and a pair of conveyor rollers 492 and further includes a first conveying direction switching means 494 disposed between the upper roller 472 and the lower roller 474 and a pair of switching conveyor rollers 476, a second conveying direction switching means 496 disposed between the pair of switching conveying rollers 476 and the pair of discharged rollers 478, and a holding section 498 for switching the conveying direction disposed below the second conveying direction switching means 496. The first conveying direction switching means is equipped with a switching guide member 500 which is adapted to be selectively held at a first position shown by solid lines in FIG. 12, a second position by two-dot chain lines 500A and a third position shown by two-dot chain lines 500B. The switching guide member 500 is held at the first position when it conducts the copying paper toward the pair of switching conveyor rollers 476 from the upper roller 472 and the lower roller 474; at the second position when it conducts the copying paper toward the conveyor rollers 490 from the upper roller 472 and the lower roller 474; and at the third position, when it conducts the copying paper toward the pair of conveyor rollers 490 from the conveying direction switching holding section 498 by the action of the pair of switching conveyor rollers 476. The second conveying direction switching means 496 is provided with a switching guide member 502 adapted to be selectively held at a second position shown by two-dot chain lines 502A in FIG. 12 and a first position shown by solid lines. The switching guide member 502 is held at the first position when it conducts the copying paper toward the pair of discharge rollers 478 from the pair of switching conveying rollers 476, and at the second position when it conducts the copying paper to the conveying direction switching holding section 498 from the upper roller 472 and the lower roller 474 by the action of the pair of switching conveyor rollers 476, or it conducts the copying paper toward the pair of conveyor rollers 490 from the switching holding section 498 by the action of the pair of switching conveying rollers 476.

The conveying direction switching holding section 498 is comprised of a pair of spaced guide holding plates 504, and in relation to the foregoing description, the switching conveyor rollers 476 can be rotated in normal and reverse directions. An oscillating guide member 506 free to oscillate between a first position shown by solid lines and a second position shown by two-dot chain lines 506A is disposed between the pair of conveyor rollers 490 and the pair of conveyor rollers 492. The oscillating guide member 506 is held at the first position when the size of copying paper is relatively small, and at the second position when the paper size is relatively large.

The paper re-feed means 488 has a copying paper receiving stand 508 which extends below the paper conveying passage from left to right in FIG. 12. A feed roller 510 constituting a feed means is disposed above the front portion of the paper receiving stand 508. The feed roller 510 is held at an operative position shown by a solid line when copying paper is received on the paper receiving stand 510 through the paper returning passage or the copying paper received in the paper receiving stand 508 is delivered, and at a non-operative position shown by a two dot chain line when the widthwise direction of the copying paper received in the paper receiving stand 508 is adjusted. Stop means 512 is disposed in the front end portion of the paper receiving stand 508. The stop means 512 is selectively held at an operative position shown by a solid line and a non-operative position shown by a two-dot chain line. Overlapping feed preventing means 518 having a pair of an upper feed roller 514 and a lower separation roller 516 is further disposed at the front end of the paper receiving stand 508.

A copying paper feed passage for conducting the copying paper fed from the paper re-feed means 488 toward the paper conveying passage is disposed downstream of the paper re-feed means 488. In the illustrated embodiment, the paper feed passage is defined by a pair of guide plates 520.

On the other hand, in the upper portion of the housing 406, an optical device shown generally at 522 is provided for scanning and exposing a document on the transparent plate 408 and projecting the image of the document onto a photosensitive material on the rotating drum 416 in the exposure zone 416. The optical device 522 has a document illuminating lamp 524 for illuminating the document placed on the transparent plate 408, and a first reflecting mirror 526, a second reflecting mirror 528, a third reflecting mirror 530, a lens assembly 532 and a fourth reflecting mirror 534 for projecting the reflected light from the document onto the photosensitive material. During scanning exposure, the document illuminating lamp 524 and the first reflecting mirror 526 are moved at a velocity V from a start-of-scan position shown by solid lines to a given position (for example, a maximum end-of-scan position shown by line two-dot chain line) substantially horizontally, and the second reflecting mirrors 528 and the third reflecting mirror 530, at a velocity ($\frac{1}{2}$V) half of the moving velocity V from a start-of-scan position shown by solid lines to a given position (for example, a maximum end-of-scan position shown by two-dot chain lines). At this time, the reflected light from the document illuminated by the document illuminating lamp 524 is reflected successively by the first, second and third reflecting mirrors 526, 528 and 530 and reaches the lens assembly 532. It is then reflected by the fourth reflecting mirror 534 and reaches the photosensitive material in the exposure zone 416.

The main copying system 402 of the copying apparatus is substantially the same as the main copying system 2 of the copying apparatus in the first embodiment except that the paper re-feed means 488 is equipped only with the feed roller 510 which successively feeds stacked copying papers on the paper receiving stand 508 from the uppermost one. Accordingly, a description of its operation is omitted.

Structure of the document sending device in the second embodiment

Now, the document sending device 404 disposed on the upper surface of the main copying system 402 of the copying apparatus will be described.

The illustrated document sending device 404 has an elongate box-like housing 550. A document feed means 552 is disposed in the right end portion of the housing 550, and a document discharge receiving portion 554 is provided on its upper surface.

Figure 13:
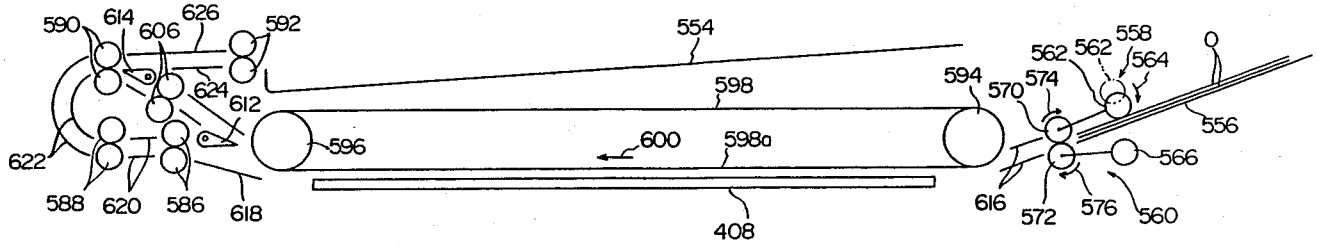
FIG. 13 is a simplified view illustrating the conveyance of a document when one surface of the document is to be copied on one surface of copying paper using the electrostatic copying apparatus shown in FIG. 12.

The illustrated document feed means 552 to which the sheet material feeding device in accordance with this invention is applied comprises a document receiving stand 556 extending exteriorly through an opening formed in the right wall of the housing 550, a first feed means 558 disposed above the document receiving stand 556 and a second feed means 560 disposed below the document receiving stand 556. The first feed means 558 has a first feed roller 562 adapted to be held in an operative state in which it acts on documents placed on the document receiving stand 556 (the state shown by a solid line) and a non-operative state (the state shown by a two-dot chain line) in which it moves away upwardly from the documents on the document receiving stand 556. As will be described hereinafter, the feed roller 562 is rotated in the direction shown by an arrow 564 (FIGS. 13 and 15). The second feed means 560 has a second feed roller 566 adapted to be selectively held in an operative state (the state shown by a solid line) in which it acts on documents placed on the document receiving stand 556 and a non-operative state (the state shown by a two-dot chain line) in which it moves away downwardly from the documents on the document receiving stand 556. (In the operative state, the second feed roller 566 can act on the documents on the document receiving stand 556 through an opening formed at an appropriate portion of the document receiving stand 556). The feed roller 566 is rotated in the direction shown by an arrow 568 (FIGS. 17-A to 17-C) as will be described hereinafter. An overlapping feed preventing mechanism comprised of a pair of an upper roller 570 and a lower roller 572 is provided at the end of the document receiving stand 556. In the overlapping feed preventing mechanism, the upper roller 570 is rotated in the direction shown by an arrow 574 and the lower roller 572, in the direction shown by an arrow 572 (FIGS. 13 and 15) when the documents placed on the document receiving stand 556 are fed one by one from the uppermost one by the action of the first feed means 558. On the other hand, when the documents are to be fed one by one from the lowermost one by the action of the second feed means 560, the upper roller is rotated in the direction shown by an arrow 578, and the lower roller 572, in the direction shown by an arrow 580 (FIGS. 17-A to 17-C).

Between the document feeding means 552 and the document discharge receiving portion 554 is disposed document conveying means 582 for conveying documents on the document receiving stand 556 through an exposure area on the transparent plate 508 in the main copying system 502. The illustrated document conveying means 582 is provided with a conveyor belt mechanism 584, conveyor roller pairs 586, 588 and 590, and a pair of discharge rollers 592. The conveyor belt mechanism 584 has a pair of rollers 594 and 596 arranged above both sides of the transparent plate 508, and an endless conveyor belt 598 is wrapped over the pair of rollers 594 and 596. In the illustrated embodiment, the lower travelling section 598*a* of the conveyor belt 598 is moved in the direction shown by an arrow 600 (FIGS. 13, 15, 17-A and 17-C) when it is desired, for example, to conduct documents on the document receiving stand 556 to the exposure area. When it is desired to conduct the documents to the exposure area through the document returning passage, the lower travelling section 598*a* is moved in the direction shown by an arrow 602 (FIG. 17-B).

Document returning means 604 defining a document returning passage is further disposed between the conveyor roller pair 590 and the roller 596 of the conveyor belt mechanism 584. The document returning means 604 includes a pair of returning rollers 606.

In the illustrated document sending device 404, a first document conveyance switching mean 608 is disposed downstream of the roller 596 of the conveyor belt mechanism 584, and a second document conveyance switching means 610, downstream of the pair of conveyor rollers 590. The first document conveyance switching means 608 has a switching guide member 612 adapted to be held at a first position shown by solid lines in FIG. 12 and a second position shown by two-dot chain lines 612A. The switching guide member 612 is held at the first position when the document is conveyed from the exposure area on the transparent plate 408 to the document discharge receiving portion 554, and at the second posirion when it is conducted to the exposure area through the document returning passage. The second document conveyance switching means 610 has a switching guide member 614 adapted to be selectively held at a first position shown by solid lines in FIG. 12 and a second position shown by two-dot chain lines 614A. The switching guide member 614 is held at the first position when the document is conveyed from the pair of conveyor rollers 590 toward the pair of discharge rollers 592, and at the second position when the document is conducted to the document returning passage from the pair of conveyor rollers 590.

Conveyance of documents by the above document sending device 404 and its relation to images formed on copying paper will now be described.

When one surface of a document is to be copied on one surface of copying paper in the second embodiment With reference to FIGS. 13 and 14, conveying of documents and its relation to image formation on copying paper will be described in regard to the case where one surface of each document is copied on one surface of each copying paper. For the sake of convenience, surfaces to be copied of documents and surfaces of copying papers on which copied images are formed are numbered.

Figure 14:
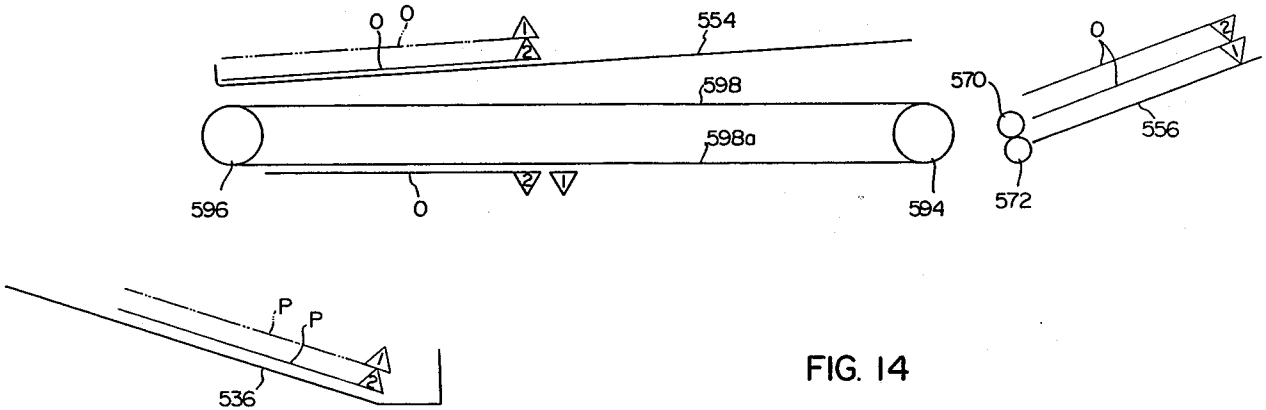
FIG. 14 is a simplified view illustrating the relationship among documents placed on the document receiving stand, documents discharged onto the document discharge section, and copying papers discharged onto the receiving tray in the case shown in FIG. 15.

In the case of copying one surface of each document on one surface of each copying paper, documents 0 to be copied are placed on the document receiving stand 556 so that one surface to copied of each document faces downward and the final document 0 is at the uppermost position, as shown in FIG. 14. The documents 0 so placed are fed toward the exposure area on the transparent plate 408 by the action of the first feed means 558. Specifically, the first feed roller 562 is held in the operative state shown by a solid line in FIG. 13 (in which it acts on the upper surface of the uppermost document 0 on the document receiving stand 556) and the second feed roller 566 is held in the non-operative state shown in FIG. 13 (in which it moves away from the lower surface of the lowermost document 0 on the document receiving stand 556). Therefore, the document feeding means is held in a first document feeding state. By the rotation of the feed roller 562 in the direction of arrow 564, the documents 0 on the document receiving stand 556 are fed successively from the uppermost one. In the first document feeding state, the upper roller 570 is rotated in the direction shown by arrow 574 and the lower roller 572, in the direction of atrow 576. As a result, the documents 0 fed by the action of the feed roller 562 undergo the separating action of the lower roller 572, and only the uppermost document 0 is accurately fed.

The document 0 fed from the document receiving stand 556 passes between a pair of guide plates 616 and is introduced between the transparent plate 408 of the main copying system 402 and the lower travelling section 598*a* of the conveyor belt 598, and is positioned in the exposure area on the transparent plate 408 by the action of the lower travelling section 598*a* moving in the direction of arrow 600. (When the document to be copied is positioned in the exposure area, the movement of the conveyor belt 598 is stopped.) When the document 0 is thus positioned, that surface of the document 0 which is to be copied faces downward and is scanned and exposed as described above, as shown in FIG. 14.

Thereafter, the lower travelling section 598*a* of the conveyor belt 598 is moved in the direction of arrow 600 and the document on the transparent plate 408 is discharged onto the document discharge receiving section 554.

In this case, the switching guide members 612 and 614 are held at the first positions shown in FIG. 13. Accordingly, by the action of the conveyor belt 598, the document on the transparent plate 408 is conveyed between guide plate 618 and the switching guide member 612 held at the first position to the pair of conveyor rollers 586. It is further conveyed between guide plates 620 to the pair of conveyor rollers 588 and further between guide plates 622 to the pair of conveyor rollers 590. Thereafter, the document 0 is conveyed between the switching guide member 614 held at the first position and guide plate 624 and guide plate 626 to the pair of discharge rollers 592, and by the action of the pair of discharge rollers 592, discharged onto the document discharge section 558. During conveyance from the transparent plate 408 to the document discharge receiving section 554, the document 0 is substantially reversed, and therefore is discharged onto the document discharge receiving section 554 with its copied surface facing upward as shown in FIG. 14.

When one surface of the document 0 is to be copied on one surface of the copying paper P in the electrostatic copying apparatus equipped with the document sending device 404, documents to be copied are placed on the document receiving stand 556 so that the surface to be copied of each document faces downward and the final document 0 is located at the uppermost position, and the documents 0 so placed are fed from the uppermost one by the action of the first feed roller 562. In relation to this, the following points should be noted. As can be understood from FIG. 14, the second document 0, for example, is conveyed to the exposure area on the transparent plate 408 with its surface to be copied (indicated by symbol 2 is FIG. 14) facing downward, and following the copying of the second document, the first document is conveyed to the exposure area with its surface to be copied (indicated by symbol 1 in FIG.

14) facing downward. The documents 0 so conveyed are discharged successively as follows. First, the second document is discharged into the document discharge receiving section 554 with its copied surface facing upward. Thereafter, the first document 0 is discharged onto the second document with its copied surface facing upward. Hence, the documents 0 discharged onto the document discharge receiving section 554 are sequenced with the first one at the top, and there is no need at all to sequence them after the copying operation. Furthermore, copying starts with the second document and the copying papers having images formed thereon are successively discharged onto the receiving tray 536 as follows. First, the copying paper having an image corresponding to the second document is discharged onto the receiving tray 536 with its image-bearing surface (indicated by symbol 2 in FIG. 14) facing upward. Then, the copying paper P having an image corresponding to the first document 0 is discharged onto the receiving tray 536 with its image-bearing surface (indicated by symbol 1 in FIG. 14) facing upward (see FIG. 12 also). Hence, the copying papers P discharged onto the receiving tray 536 are also sequenced with the image-bearing surfaces facing upward and the copy corresponding to the first document located at the top. It is not necessary therefore to sequence the copies after the copying operation.

When one surface of one document and one surface of the next document are to be copied on both surfaces of copying paper in the second embodiment Now, with reference to FIGS. 15 and 16, conveyance of documents and its relation to image formation on copying paper will be described in regard to the case where one surface of a document and one surface of the next document are to be copied on both surfaces of copying paper.

When one surface of each document 0 is to be copied, documents 0 to be copied are placed on the document receiving stand 556 so that one surface of each document to be copied faces downward and the final document 0 is located at the uppermost position, as shown in FIG. 16. Documents 0 thus placed are fed toward the exposure area of the transparent plate 408 by the action of the first feed means 558 in the same way as described above. Specifically, the first feed roller 562 is held in the operative state shown by a solid line in FIG. 15 (in which it acts on the upper surface of the uppermost document 0 on the document receiving stand 556), and the second feed roller 566, in the non-operative state shown in FIG. 15 (in which it moves away from the under surface of the lowermost document on the document receiving stand 556 (and therefore, the document feeding means 552 is held in the first document feeding state). By rotating the first feed roller 562 in the direction shown by arrow 564, the documents on the document receiving stand 556 are successively fed from the uppermost one. In the first document feeding state, the upper roller 570 is rotated in the direction of arrow 574 and the lower roller 572, in the direction of arrow 576. Thus, the fed documents 0 undergo the separating action of the lower roller 572, and only the uppermost document 0 is accurately fed.

The document 0 fed from the document receiving stand 556 passes between the pair of guide plates 616 and is introduced between the transparent plate 408 of the main copying system 402 and the lower travelling section 598*a* of the conveyor belt 598. It is then positioned in the exposure area on the transparent plate 408 by the action of the lower travelling section 598*a* moving in the direction of arrow 600 of the conveyor belt 598 (when the document 0 is positioned in the exposure area, the movement of the conveyor belt 598 is stopped). When the document 0 is thus positioned, its surface to be copied faces downward and is scanned and exposed as described hereinabove.

Thereafter, the lower travelling section 598*a* of the conveyor belt 598 is moved in the direction of arrow 600, and the document 0 on the transparent plate 408 is discharged onto the document discharge receiving section 554. In this case, the switching guide members 612 and 614 are held at the first positions shown in FIG. 15. Accordingly, the document 0 on the transparent plate 408, by the action of the conveyor belt 598, is conveyed between the guide plate 618 and the switching guide member 612 at the first position to the pair of conveyor rollers 586. It is then conveyed between the pair of guide plates 620 to the pair of conveying rollers 588 and further between the pair of guide plates 622 to the pair of cnveyor rollers 590. Thereafter, the document 0 advances past the switching guide member 614 held at the first position and the guide plate 624 and the guide plate 626, and by the action of the pair of discharge rollers 592 is discharged onto the document discharge section 554. During conveyance from the transparent plate 408 to the document discharge section 554, the document 0 is substantially reversed and therefore discharged onto the document discharge section 554 with its copied surface facing upward as shown in FIG. 16.

When one surface of a document and one surface of the next document are to be copied successively on both surfaces of copying paper in the electrostatic copying apparatus equipped with the document sending device 404, documents 0 to be copied are placed on the document receiving stand 556 so that one surface of each document to be copied faces downward and the final document 0 is located at the uppermost position, and the documents 0 so placed are fed from the uppermost one by the action of the feed roller 562. In relation to this, the following points should be noted. Specifically, as can be understood from FIG. 16, the fourth document 0, for example, is conveyed to the exposure area on the transparent plate 408 with its surface to be copied (indicated by symbol 4 in FIG. 16) facing downward. After copying of the fourth document, the third document 0 is conveyed to the exposure area with its surface to be copied (indicated by symbol 3 in FIG. 16) facing downward. Subsequently, the second document (the surface to be copied is marked 2 is conveyed, and then the first document 0 (the surface to be copied is marked 1 in FIG. 16) is conveyed. The documents 0 so conveyed are discharged successively as follows. First, the fourth document 0 is discharged onto the document discharge section 554 with its copied surface facing upward. Then, the third document 0 is discharged onto the fourth document 0 with its copied surface facing upward. Thereafter, the second document 0 is discharged onto the third document, and then the first document, onto the second document 0. Accordingly, the documents 0 discharged onto the document discharge section 554 are sequenced with the copied surfaces facing upward and the first document 0 at the top as shown in FIG. 16. There is not need to sequence the documents 0 after the copying operation. The documents 0 are copied successively on both surfaces of copying papers P starting with the fourth document, and copying papers having copied images formed on both surfaces are discharged onto the receiving tray 536 as follows. First, during conveyance through the paper conveying passage, an image corresponding to the fourth document is formed on one surfce of copying paper P, and the copying paper P is received in the paper receiving stand 508 with its image-bearing surface (indicated by symbol 4 in FIG. 16) facing upward. Then, while the copying paper P fed from the paper receiving stand 508 is again conveyed through the paper conveying passage, an image corresponding to the third document 0 is formed on the other surface of the copying paper. The copying paper P having copied images on both surfaces is discharged onto the receiving tray 536 with its surface bearing the image corresponding to the third document (the surface marked by 3 in FIG. 16) facing upward (see FIG. 12 also). Subsequently, while the next copying paper P is conveyed through the paper conveying passage, an image corresponding to the second document 0 is formed on one surface of the next copying paper, and this copying paper P is received on the paper receiving stand 508 with its image-bearing surface (indicated by symbol 2 in FIG. 16) facing upward. Thereafter, while the copying paper P fed from the paper receiving stand 508 is re-conveyed through the paper conveying passage, an image corresponding to the first document 0 is formed on the other surface of the copying paper. The copying paper P having copied images formed on both surfaces is discharged onto the copying paper P on the receiving stand 536 with its surface bearing the image corresponding to the first document 0 (the surface indicated by symbol 1 in FIG. 16) facing upward. Hence, the copying papers P discharged onto the receiving tray 536 as shown in FIG. 16 are sequenced with the image corresponding to the first document 0, the image corresponding to the second document, the image corresponding to the third document and the image corresponding to the four document formed respectively on the upper surface and lower surface of the first copying paper and the upper surface and the lower surface of the second copying paper. There is no need at all to sequence the copied after the copying operation.

When both surfaces of a document are copied on both surfaces of copying paper in the second embodiment Now, with reference to FIGS. 17-A to 17-C and 18, conveying of documents and its relation to image formation on copying paper will be described in regard to the case where both surfaces of a document are successively copied on both surfaces of the copying paper.

Figure 18:
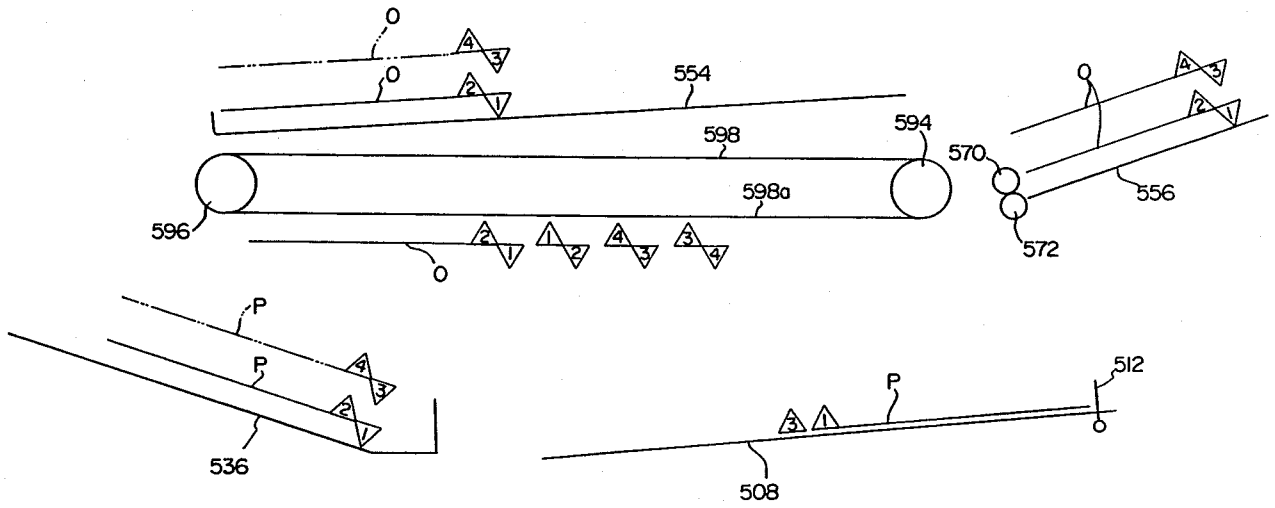
FIG. 18 is a simplfied view illustrating the relationship among documents placed on the document receiving stand, copying papers received in the paper re-feed means, documents discharged onto the document discharge section and copying papers discharged onto the receiving tray in the case shown in FIGS. 17-A to 17-C.

When both surfaces of a document are to be copied, documents to be copied are placed on the document receiving stand 556 so that their first pages face downward and the final document 0 is located at the uppermost position shown in FIG. 18. The documents 0 so placed are fed toward the exposure area on the transparent plate 408 by the action of the second feed means 560 rather than the first feed means 558. Specifically, the second feed roller 566 is held in the operative state shown in FIG. 17-A by a solid line and in FIGS. 17-B and 17-C (in which it acts on the under surface of the lowermost document 0 on the document receiving stand 556) and the first feed roller 562, in the non-operative state shown in FIGS. 17-A to 17-C (in which it moves away upwardly from the uppermost document 0 on the document receiving stand 556). Therefore, the document feed means 552 is held in the second document feeding state. By the rotation of feed roller 566 in the direction of arrow 568, the documents 0 on the document receiving stand 556 are fed successively from the lowermost one. In the second document feeding state, the upper roller 570 is rotated in the direction shown by arrow 578 (FIG. 17-A) and the lower roller 572, in the direction of arrow 580 (FIG. 17-A). As a result, the documents 0 fed by the action of the feed roller 566 undergo the separation action of the upper roller 570, and only the lowermost document 0 is accurately fed.

The document 0 fed from the document receiving stand 556 advances between the pair of guide plates 616 and is introduced between the transparent plate 408 and the lower travelling section **598*a* of the conveyor belt 598. By the action of the lower travelling section 598*a* moving in the direction of arrow 600, it is positioned in the exposure area of the transparent plate 408 (when the document 0 to be copied is so positioned, the movement of the conveyor belt 598 is stopped). When the document 0 is thus positioned, its first page faces downward as shown in FIG. 18**, and is thus scanned and exposed in the manner described hereinabove.

When both surfaces of document 0 are to be copied, the second page of the document 0 is then scanned and exposed. In the illustrated embodiment, the lower travelling section **598*a* of the conveyor belt 598 is first moved in the direction shown by arrow 600 after the end of the scanning exposure. The switching guide member 614 is brought from the first position shown in FIG. 17-A to the second position shown in FIG. 17-B. At this time, the switching guide member 612 is held at the first position shown in FIG. 17-A. Hence, by the action of the conveyor belt 598, the document 0 on the transparent plate 408 is conveyed between the guide plate 618 and the switching guide member 612 held at the first position to the pair of conveyor rollers 586. It is then conveyed between the pair of guide plates 620 to the pair of conveyor rollers 588, and further between the pair of guide plates 622 to the pair of conveyor rollers 590. The document 0 so conveyed is then introduced into the paper returning passage via the space between the switching guide member 614 held at the second position and guide plate 628, and conveyed between the switching guide member 614 and the guide plate 628 to the pair of conveyor rollers 606. It further advances between guide plate 632, guide plate 630 and the switching guide member 612 and is introduced between the transparent plate 408 and the lower travelling section 598*a* of the conveyor belt 598. In the illustrated embodiment, when the trailing end of the document 0 leaves the conveyor belt 598, the moving direction of the conveyor belt 598 is reversed, and the lower travelling section 598*a* is moved in the direction of arrow 602 which is opposite to the direction of arrow 600. When the trailing end of the document 0 goes past the switching guide member 612, the switching guide member 612 is held at the second position as shown in FIG. 17-B. Accordingly, the document 0 introduced into the document returning passage as mentioned above is guided by the upper surface of the switching guide member 612 held at the second position and is introduced from its leading end between the lower travelling section 598*a* of the conveyor belt 598 and the transparent plate 408, and again positioned in the exposure area on the transparent plate 408 by the action of the lower travelling section 598*a* moving in the direction of arrow 602 (when the document is so positioned, the movement of the conveyor belt 598 is again stopped). When the document 0 is thus positioned, the document 0 is substantially reversed during its movement through the document returning passage as shown in FIG. 18. Hence, the second page of the document 0** faces downward and is scanned and exposed as is described hereinabove.

When the first and second pages of the document 0 have been scanned and exposed, the lower travelling section 598*a* of the conveyor belt 598 is moved in the direction of arrow 600, and the switching guide members 612 and 614 are held at the first positions. Hence, the document 0 on the transparent plate 408 is conveyed between the guide plate 618 and the switching guide member 612 at the first position to the pair of conveyor rollers 586, the pair of conveyor rollers 588 and the pair of conveyor rollers 590, and further passes between the switching guide member 614 at the first position and the guide plate 624 and the guide plate 626. By the action of the pair of discharge rollers 592, it is discharged onto the document discharge section 554. Since in the illustrated embodiment, the document 0 is substantially reversed while it is conveyed from the transparent plate 408 to the document discharge section 554, the document 0 is discharged onto the document discharge section 554 with its copied second page facing upward as shown in FIG. 18.

When both surfaces of document 0 are to be copied on both surfaces of copying paper P successively in the electrostatic copying apparatus equipped with the above document sending device 404, documents to be copied are placed on the document receiving stand 556 so that their first pages face downward and the final document 0 is located at the uppermost position, and the documents 0 so placed are fed from the lowermost one by the action of the second feed roller 566. In relation to this, the following points should be noted. As can be seen from FIG. 18, the first document is conveyed from the document receiving stand 556 to the exposure area on the transparent plate 408 with its first page (indicated by symbol 1 in FIG. 18) facing downward. After copying the first page, this document 0 is again conveyed to the exposure area with its second page (indicated by symbol 2 in FIG. 18) facing downward. After the copying of the first and second pages, the first document 0 is discharged onto the document discharge section 554 with its copied second page facing upward. Subsequently, the second document 0 is conveyed to the exposure area from the document receiving stand 556 with its first page (indicated by symbol 3 in FIG. 18) facing downward, and after the first page is copied, the second document is again conveyed with its second page facing downward. Thereafter, the second document is discharged onto the second page of the first document discharged onto the document discharge section 554 with the copied second page facing upward. Accordingly, as shown in FIG. 18, the documents 0 discharged onto the document discharge section 554 are sequenced with the first pages facing downward, the second pages facing upward and the first document at the bottom. It is not necessary at all to sequence the documents after the copying operation.

In relation to the above conveyance of the documents 0 as mentioned above, copying papers having copied images on both surfaces are discharged onto the receiving tray 536 as follows. First, during conveyance through the paper conveying passage, an image corresponding to the first page of the first document 0 is formed on one surface of copying paper P, and the copying paper is received in the paper receiving stand 508 with its image-bearing surface (indicated by symbol 1 in FIG. 18) facing upward. Then, while the copying paper fed from the paper receiving stand 508 is conveyed through the paper conveying passage, an image corresponding to the second page of the first document 0 is formed on the other surface of the copying paper. The copying paper P having copied images on both surfaces is then discharged onto the receiving tray 536 with its surface bearing the image corresponding to the second page of the first document 0 (the surface indicated by symbol 2 in FIG. 18) facing upward (see FIG. 12 also). Subsequently, while the next copying paper P is conveyed through the paper conveying passage, an image corresponding to the first page of the second document 0 is formed on one surface of this copying paper. This copying paper is also received in the paper receiving stand 508 with its image-bearing surface facing upward. Thereafter, while this copying paper fed from the paper receiving stand 508 is again conveyed through the paper conveying passage, an image corresponding to the second page of the second document is formed on the other surface of this copying paper. The copying paper P having copied images on both surfaces is discharged onto the first copying paper P on the receiving stand 536 with its surface having the image corresponding to the second page of the second document (the surface indicated by symbol 4 in FIG. 18) facing upward. Accordingly, the copying papers P discharged onto the receiving tray 536 are sequenced with the surfaces bearing images corresponding to the first pages of the documents 0 facing downward and the copy corresponding to the first document located at the bottom. There is no need to sequence the copies after the copying operation.

When both surfaces of a document 0 are to be copied on both surfaces of copying paper P, the document may be fed in the following manner by using the first feed means 558 instead of the second feed means 560. However, inconveniences to be described below arise in this case. Documents 0 to be copied are placed on the document receiving stand 556 so that their first pages face downward and the final document is located at the uppermost position. The documents 0 so placed are successively fed from the uppermost one by the action of the first feed means 558. Each fed document 0 is first conveyed through the paper returning passage to position it in the exposure area with its second page facing downward. After the second page is scanned and exposed, the document 0 is again conveyed through the paper returning passage to thereby position it in the exposure area with its first page facing downward. After the scanning exposure of the first and second pages, the document 0 may be discharged onto the document discharge section 554. It will be understood from the foregoing description that the documents 0 discharged onto the document discharge receiving section 554 are sequenced with the first pages facing upward, the second pages facing downward and the first document located at the top, and that the copying papers P discharged onto the receiving tray 536 are also sequenced with the surfaces having the images corresponding to the first pages of the documents 0 facing upward and the copy corresponding to the first document 0 located at the uppermost position. In this alternative, however, a longer period of time is required for conveying the document 0 and the speed of copying is reduced because the document is scanned from the second page by conveying it first through the document returning passage, or the number of conveying operations through the document returning passage increases to make the document conveyance unstable.

In the illustrated embodiment, the documents 0 are fed from the lowermost one by utilizing the second feed means 560, and therefore, it is not necessary to convey the document 0 through the document returning passage during the first scanning exposure. The above inconvenience can therefore be avoided. The copying speed can be increased, and the conveying of the document can be stabilized.

Modified example of the second embodiment

In the illustrated embodiment, images can be overlappingly formed on one surface of copying paper. In this case, the switching guide member 500 is held at the second position shown by two-dot chain lines 500A and the switching guide member 502, at the first position shown by a solid line. Hence, copying paper having an image formed on one surface during conveyance through the paper conveying passage is guided by the right side edge of the switching guide member 500 held at the second position, introduced into the paper returning passage, and through the paper returning passage, received properly on the paper receiving stand 508 of the paper re-feed means 488 with its image-bearing surface facing downward. Thereafter, this copying paper is fed from the paper re-feed means 488 to the paper conveying passage via the paper re-feed passage. Accordingly, in the case of copying both surfaces of a document on one surface of paper, the following inconveniences may arise because the copying paper is received on the paper receiving stand 508 with its image-bearing surface facing downward. When the uppermost copying paper in the stack is fed by the action of the feed roller 510, toner particles existing on the image-bearing under surface of the uppermost copying paper tend to adhere to the upper surface (with no copied image) of copying paper beneath it. On the other hand, since the uppermost copying paper is moved relative to the stationary copying paper underneath, the region of action of the paper feeding pressure on the lower copying paper via the uppermost copying paper does not substantially vary. Thus, the under surface of the uppermost paper makes rubbing contact with a specific site (the site corresponding to the feed roller 510) of the upper surface of the copying paper beneath it. Hence, soiling occurs in the specific site of the lower paper and appears markedly on the other surface of the copying paper.

In order to avoid such inconveniences, the paper re-feeding means 488 should preferably be provided with a feed roller for feeding copying papers from the lowermost one (which corresponds to the second feed roller 190 in the first embodiment) in addition to the feed roller 510 for feeding them from the uppermost one, as in the first embodiment. When copying paper is received with its image-bearing surface facing upward (in the case of both-surface copying), it is desirable to feed it from the paper receiving stand 550 by the action of the feed roller 510, and when the paper is received with its image-bearing surface facing downward (in the case of forming an image overlapping on one surface of paper), it is desirable to feed it from the paper receiving stand 150 by the action of such a feed roller for feeding the papers from the lowermost one.

By so doing, the lowermost paper is moved with respect to paper located above the lowermost one. Hence, the upper surface of the lowermost paper (no copied image is formed on this surface) comes into rubbing contact with the under surface (bearing a copied image) of the upper copying paper entirely in the feeding direction. Consequently, toner particles existing on the under surface of the upper copying paper are effectively prevented from adhering to, and contaminating, the upper surface of the lowermost paper.

The above description has been directed to the use of two to four documents to produce copies in order to simplify the description and thus make it easily understandable. It should be understood however that the same copying operation can be performed even when more documents are used.

What is claimed is:

1. In an electrostatic copying apparatus capable of both-surface copying and including a main copying system and a document sending device for conveying a document to be copied through an exposure area, said main copying system including copying paper conveying mans defining a copying paper conveying passage, image forming means for forming an image of a document to be copied on copying paper conveyed through said paper conveying passage, copying paper returning means defining a copying paper returing passage for returning copying paper having the image formed on one surface thereof, and paper re-feed means for receiving the copying paper returned through said paper returning passage and feeding it again to said paper conveying passage, the improvement wherein said document sending device comprises:

document feed means for feeding the document toward the exposure area;

document conveying means for conveying the document through the exposure area;

document returning means defining a document returning passage for conducting the document conveyed through the exposure area to the exposure area again; and said document feed means comprising a document receiving stand for receiving a stack of documents, a first feed means for feeding documents placed on said document receiving stand one at a time from the uppermost document of the stack, and a second feed means for feeding the documents placed on said document receiving stand one at a time from the lowermost document of the stack.

2. The improvement claimed in claim 1, wherein:

said first feed means comprises a first feed roller selectively movable between a non-operative state spaced from the documents on said document receiving stand and an operative state in contact with the uppermost document on said document receiving stand;

said second feed means comprises a second feed roller selectively movable between a non-operative state spaced from the documents on said document receiving stand and an operative state in contact with the lowermost document on said document receiving stand; and said document feed means further comprises means for selectively moving said first feed roller to said operative state thereof and said second feed roller to said non-operative state thereof, thereby defining a first document feeding state wherein the documents on said document receiving stand are fed successively from the uppermost one by said first feed roller, and for selectively moving said second feed roller to said operative state thereof and said first feed roller to said non-operative state thereof, thereby defining a second document feeding state wherein the documents on said document receiving stand are fed successively from the lowermost one by said second feed roller.

3. In an electrostatic copying apparatus capable of both-surface copying and including a main copying system and a document sending device for conveying a document to be copied through an exposure area, said main copying system including copying paper conveying means defining a copying paper conveying passage, image forming means for forming an image on a document to be copied on copying paper conveyed through said paper conveying passage, copying paper returning means defining a copying paper returning passage for returning copying paper having the image formed on one surface thereof, and paper re-feed means for receiving the copying paper returned through said paper returning passage and feeding it again to said paper conveying passage, the improvement wherein said paper re-feed means comprises:

a copying paper receiving stand for receiving a stack of copying papers returned through said paper returning passage;

first feed means for feeding the copying papers in said copying paper receiving stand one at a time from the uppermost copying paper of the stack; and second feed means for feeding the copying papers in said copying paper receiving stand one at a time from the lowermost copying paper of the stack.

4. The improvement of claim 3, wherein:

said first feed means comprises a first feed roller selectively movable between a non-operative state spaced from the copying papers on said paper receiving stand and an operative state in contact with the uppermost paper on said paper receiving stand;

said second feed means comprises a second feed roller selectively movable between a non-operative state spaced from the copying papers on said paper receiving stand and an operative state in contact with the lowermost paper on said paper receiving stand; and said paper re-feed means further comprises means for selectively moving said first feed roller to said operative state thereof and said second feed roller to said non-operative state thereof, thereby defining a first paper re-feeding state wherein the copying papers on said paper receiving stand are successively fed from the uppermost one by said first feed roller, and for selectively moving said second feed roller to said operative state thereof and said first feed roller to said non-operative state thereof, thereby defining a second paper re-feed state wherein the copying papers on said paper receiving stand are successively fed from the lowermost one by said second feed roller.

5. The improvement of claim 3, wherein said document sending device comprises a document receiving stand for placing thereon documents to be copied, document feed means for feeding the document on said document receiving stand toward the exposure area, document conveying means for conveying the documents through the exposure area, a document discharge section onto which the documents are discharged, first document discharge means for discharging the documents conveyed through the exposure area onto said document discharge section with first ends of the documents leading into said document discharge section, and second document discharge means for discharging the documents conveyed through the exposure area onto said document discharge section with second ends of the documents, opposite to the first ends thereof, leading into said document discharge section.

6. A device for feeding sheet materials comprising:

a receiving stand for receiving a stack of sheet materials;

first feed means disposed above said receiving stand and selectively movable between an operative state in contact with the upper surface of the uppermost sheet material on said receiving stand and a non-operative state spaced from the sheet materials on said receiving stand;

second feed means disposed below said receiving stand and selectively movable between an operative state in contact with the under surface of the lowermost sheet material on said receiving stand and a non-operative state spaced from the sheet materials on said receiving stand;

means for selectively moving said first feed means to said operative state thereof and said second feed means to said non-operative state thereof, thereby defining a first feeding state wherein the sheet materials are successively fed from the uppermost one in the stack by said first feed means, and for selectively moving said first feed means to said non-operative state thereof and said second feed means to said operative state thereof, thereby defining a second feeding state wherein the sheet materials are fed successively from the lowermost one in the stack by said second feed means; and overlapping feed preventing means for preventing overlapping feed of the sheet materials delivered by said first and second feed means from said receiving stand.

7. The device of claim 6, wherein said overlapping feed preventing means comprises first and second rollers coacting to prevent overlapping feed of the sheet materials.

8. The device of claim 7, wherein said overlapping feed preventing means further comprises:

a first torque limiter mechanism and a second torque limiter mechanism annexed respectively to said first roller and said second roller;

means for, in said first feeding state, rotating said first roller in the sheet feeding direction and rotating said second roller in a direction opposite to the rotating direction of said first roller by said second torque limiter mechanism; and means for, in said second feeding state, rotating said second roller in the sheet feeding direction and rotating said first roller in a direction opposite to the rotating direction of said second roller by said first torque limiter mechanism.

9. A process of copying one surface of a document to be copied on one surface of copying paper in an electrostatic copying apparatus capable of both-surface copying, said process comprising:

in a document sending device, placing documents to be copied on a document receiving stand so that one surface to be copied of each document faces downward and the final document is located at the uppermost position, conveying said documents successively from the uppermost one to an exposure area by a first feed means, exposing said one surface of each said document in said exposure area, and then discharging said documents onto a document discharge section; and meanwhile in a main copying system, forming an image corresponding to said one surface of each said document while it is located in said exposure area on one surface of a copying paper by an image forming means while said copying paper is conveyed through a paper conveying passage, and discharging said copying paper having said image formed on said one surface thereof from said main copying system.

10. A process of copying one surface each of two successive documents to be copied on opposite surfaces of copying paper in an electrostatic copying apparatus capable of both-surface copying, said process comprising:

in a document sending device, placing documents to be copied on a document receiving stand so that one surface to be copied of each document faces downward and the final document is located at the uppermost position, conveying said documents successively from an uppermost one to an exposure area by first feed means, exposing said one surface of each said document in said exposure area, and then discharging said documents onto a document discharge section; and meanwhile in a main copying system, forming an image corresponding to one document while it is located in said exposure area on one surface of a copying paper by an image forming means while said copying paper is conveyed through a paper conveying passage, passing said copying paper having said image formed on said one surface thereof to a paper re-feed means through a paper returning passage, thereafter conveying said copying paper from said paper re-feed means again through said paper conveying passage, forming an image corresponding to the next said document while it is located in said exposure area on the other surface of said copying paper by said image-forming means, and discharging said copying paper having said images formed on both said surfaces thereof from said main copying system.

11. A process of copying both surfaces of documents to be copied successively on opposite surfaces of copying papers in an electrostatic copying apparatus capable of both-surface copying, said process comprising:

in a document sending device, placing documents to be copied on a document receiving stand so that their first pages face downward and the final document is located at the uppermost position, conveying said documents successively from the lowermost one to an exposure area by a second feed means, exposing the first page of each document at said exposure area, then conveying each document through a document returning passage and again positioning said document at said exposure area, then exposing the second page of said document at said exposure area, and then discharging said document onto a document discharge section; and meanwhile in a main copying system, forming an image corresponding to said first page of each document while it is located in said exposure area on one surface of a copying paper by an image forming means while said copying paper is conveyed through a paper conveying passage, passing said copying paper having said image formed on one surface thereof to a paper re-feed means through a paper returning passage, thereafter conveying said copying paper from said paper re-feed means again through said paper conveying passage, forming an image corresponding to the second page of said document while it is located again in said exposure area on the other surface of said copying paper by said image forming means, and discharging said copying paper having the images formed on both said surfaces thereof from said main copying system.

12. A process of copying one surface of a document to be copied on one surface of copying paper in an electrostatic copying apparatus capable of both-surface copying, said process comprising:

in a document sending device, placing documents to be copied on a document receiving stand so that one surface to be copied of each document faces upward and the final document is located at the lowermost position, conveying said documents successively from the lowermost one to an exposure area by a document feed means, exposing said one surface of each said document in said exposure area, and then discharging said documents onto a document discharge section by a first document discharge means; and meanwhile in a main copying system, forming an image corresponding to the document while it is located in said exposure area on one surface of a copying paper by an image forming means while said copying paper is conveyed through a paper conveying passage, and discharging said copying paper having said image formed on said one surface thereof from said main copying system.

13. A process of copying one surface each of two successive documents on opposite surfaces of copying paper in an electrostatic copying apparatus capable of both-surface copying, said process comprising:

in a document sending device, placing documents to be copied on a document receiving stand so that one surface to be copied of each document faces upward and the final document is located at the lowermost position, conveying said documents successively from a lowermost one to an exposure area by a document feed means, exposing said one surface of each said document in said exposure area, and thereafter discharging said documents onto a document discharge section; and meanwhile in a main copying system, forming an image corresponding to one document while it is located in said exposure area on one surface of a copying paper by an image forming means while said copying paper is conveyed through a paper conveying passage, passing said copying paper having said image formed on said one surface thereof through a paper returning passage to a paper re-feed means, thereafter conveying said copying paper from said paper re-feed means again through said paper conveying passage, forming an image corresponding to the next said document while it is located in said exposure area on the other surface of said copying paper by said image forming means, and discharging said copying paper having said images formed on both said surfaces thereof from said main copying system.

14. A process of copying both surfaces of documents to be copied on opposite surfaces of copying papers in an electrostatic copying apparatus capable of both-surface copying, said process comprising:

in a document sending device, placing documents to be copied on a document receiving stand so that the first page of each document faces upward and the final document is located at the lowermost position, discharging said documents successively onto a document discharge section through an exposure area by a document feed means, a document conveying means and a second document discharge means, thereby relocating said documents so that their second pages face upward and the final document is located at the lowermost position, then successively feeding said relocated documents from the lowermost one from said document receiving stand by said document feed means, exposing said second pages in said exposure area, discharging said documents onto said document discharge section by said second document discharge means, whereby said documents are positioned so that their first pages face upward and the final document is located at the lowermost position, thereafter successively feeding said documents having said second pages so exposed from the lowermost one again from said document receiving stand by said document feed means, exposing said first pages at said exposure area, and then discharging said documents onto a document discharge section by a first document discharge means; and meanwhile in a main copying system, forming an image corresponding to said second page of each document while it is located in said exposure area on one surface of a copying paper by an image forming means while said copying paper is conveyed through a paper conveying passage, returning said copying paper having said image formed on said one surface thereof through a paper returning passage to a paper re-feed means, feeding copying papers received in said paper re-feed means one by one from the lowermost one by a second feed roller again through said paper conveying passage, while forming an image corresponding to the first page of said document again located in said exposure area on the other surface of each said copying paper by said image forming means, and discharging said copying papers having said images formed on both sufaces thereof from said main copying system.

15. The process of claim 14, further comprising, when paper jamming occurs during coping of the first pages of the documents:

placing documents corresponding to removed jammed papers on said document receiving stand so that the second pages of said documents face upward and the final document is located at the uppermost position;

successively feeding said document from said document receiving stand for re-copying from the lowermost one by said document feed means;

exposing the second pages of such documents at said exposure area;

discharging said documents onto said document discharge section by said first document discharge means;

thereafter again placing said documents to be re-copied on said document receiving stand so that their first pages face upward and the final document is located at the lowermost position;

again successively feeding said documents so placed from the lowermost one by staid document feed means;

exposing the first pages of said documents at said exposure area, and then discharging said documents onto said document discharge section by said first document discharge means; and meanwhile, in said main copying system:

while newly conveying a copying paper through said paper conveying passage, forming on one surface thereof an image corresponding to the second page of a document while it is located in said exposure zone, by said image forming means;

returning such new copying paper having said image formed on said one surface thereof through said paper returning passage to said paper receiving stand of said paper re-feed means;

thereafter feeding the copying papers corresponding to the documents re-copied one by one from the uppermost one by said first feed roller; and forming an image corresponding to the first page of each document again located at said exposure area on the other surface of each new copying paper so fed.

* * * * *

UNITED STATES PATENT AND TRADEMARK OFFICE

CERTIFICATE OF CORRECTION

PATENT NO. : 4,799,079

DATED : January 17, 1989

INVENTOR(S) : Koji UJINO et al.

It is certified that error appears in the above-identified patent and that said Letters Patent is hereby corrected as shown below:

Column 38, line 23, change "mans" to --means--;

Column 39, line 15, change "image on" to --image of--;

Column 44, line 4, change "coping" to --copying--;

Column 44, line 24, change "staid" to --said--.

Signed and Sealed this

Eighteenth Day of July, 1989

*Attest:*

*Attesting Officer*

DONALD J. QUIGG

*Commissioner of Patents and Trademarks*